US008000639B2

(12) United States Patent
Goto et al.

(10) Patent No.: US 8,000,639 B2
(45) Date of Patent: Aug. 16, 2011

(54) DEVELOPING DEVICE AND IMAGE FORMING APPARATUS

(75) Inventors: Hiroshi Goto, Okazaki (JP); Takuya Okada, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 294 days.

(21) Appl. No.: 12/076,109

(22) Filed: Mar. 13, 2008

(65) Prior Publication Data

US 2008/0226350 A1 Sep. 18, 2008

(30) Foreign Application Priority Data

Mar. 15, 2007 (JP) ..... 2007-067223

(51) Int. Cl.
*G03G 15/08* (2006.01)

(52) U.S. Cl. ..... 399/285; 399/282

(58) Field of Classification Search ..... 399/270, 399/281, 282, 283, 285
See application file for complete search history.

(56) References Cited

U.S. PATENT DOCUMENTS

| | | | | |
|---|---|---|---|---|
| 4,383,497 | A | 5/1983 | Tajima | |
| 5,832,350 | A * | 11/1998 | Kumasaka et al. | 399/282 |
| 6,829,448 | B2 * | 12/2004 | Ozawa et al. | 399/270 X |
| 7,043,175 | B2 * | 5/2006 | Komoto et al. | 399/270 X |

FOREIGN PATENT DOCUMENTS

| | | | |
|---|---|---|---|
| JP | 56-40862 | A | 4/1981 |
| JP | 2000-250294 | * | 9/2000 |
| JP | 2000-250294 | A | 9/2000 |
| JP | 2003-21966 | A | 1/2003 |
| JP | 2003-280357 | A | 10/2003 |
| JP | 2005-10290 | A | 1/2005 |
| JP | 2005-99344 | A | 4/2005 |
| JP | 2005-242281 | A | 9/2005 |
| JP | 2006-308687 | A | 11/2006 |

OTHER PUBLICATIONS

English translation of Hearing dated Apr. 27, 2010 for Japanese Patent Publication No. 2007-067223.
Hearing dated Apr. 27, 2010 for Japanese Patent Publication No. 2007-067223.

* cited by examiner

*Primary Examiner* — Sandra L Brase
(74) *Attorney, Agent, or Firm* — Buchanan Ingersoll & Rooney PC

(57) ABSTRACT

A developing device is disclosed that is capable of preventing the hysteresis phenomenon, and which contains a toner and a carrier. The toner and the carrier are charged to different polarities by frictional contact thereof. The developing device has a first conveyance member and a second conveyance member which faces an electrostatic latent image bearing body via the second region. An electric field forming device forms a first electric field between the first conveyance member and the second conveyance member to move the toner in the developer retained by the first conveyance member to the second conveyance member, and forms a second electric field between the second conveyance member and the electrostatic latent image bearing body to move the toner retained by the second conveyance member to an electrostatic latent image of the electrostatic latent image bearing body.

6 Claims, 16 Drawing Sheets

$$\text{RECOVERY SIDE DUTY RATIO} = \frac{t1}{t1+t2} \times 100\,[\%]$$

DIFFERENCE OF WHITE AND SOLID CHARGE AMOUNTS / WHITE CHARGE AMOUNT

| | 2000Hz | 3000Hz | 4000Hz |
|---|---|---|---|
| 90 | 0.20 | 0.22 | 0.26 |
| 80 | 0.03 | 0.05 | 0.08 |
| 70 | 0.05 | 0.03 | 0.04 |
| 60 | 0.05 | 0.05 | 0.09 |
| 50 | 0.16 | 0.15 | 0.20 |
| 50 | 0.15 | 0.15 | 0.20 |
| 40 | 0.19 | 0.20 | 0.23 |
| 30 | 0.21 | 0.19 | 0.21 |
| 20 | 0.23 | 0.22 | 0.24 |
| 10 | 0.22 | 0.23 | 0.25 |

DIFFERENCE OF WHITE AND SOLID CHARGE AMOUNTS / WHITE CHARGE AMOUNT

| | 700V | 900V | 1200V |
|---|---|---|---|
| 90 | 0.29 | 0.21 | 0.20 |
| 80 | 0.16 | 0.05 | 0.05 |
| 70 | 0.14 | 0.05 | 0.03 |
| 60 | 0.18 | 0.08 | 0.05 |
| 50 | 0.21 | 0.18 | 0.12 |
| 40 | 0.26 | 0.24 | 0.18 |
| 30 | 0.29 | 0.21 | 0.20 |
| 20 | 0.33 | 0.22 | 0.19 |
| 10 | 0.31 | 0.26 | 0.20 |

DEVELOPING DEVICE AND IMAGE FORMING APPARATUS

RELATED APPLICATION

This application is based on Japanese Patent Application No. 2007-67223, the content of which is incorporated herein by reference.

BACKGROUND OF THE INVENTION

The present invention relates to an electrophotographic image forming apparatus and a developing device used for the image forming apparatus As a development method adopted for the electrophotographic image forming apparatus, a monocomponent development method using only a toner as a main component of developer, and a two-component development method using a toner and a carrier as main components of developer are known.

The developing device of the monocomponent development method has a toner bearing member which bears and conveys a toner and a friction charge member which comes into contact with the toner bearing face of the toner bearing member. Upon passing through a contact position with the friction charge member, the toner borne by the toner bearing member comes into frictional contact with the friction charge member so as to be formed into a thin layer and charged to predetermined polarity. Thus, in the monocomponent developing device, a toner is charged by frictional contact with the friction charge member, which brings such advantages that the structure can be simple, small, and inexpensive. However, since the toner is subjected to strong stress at the contact position with the friction charge member, the toner is prone to deterioration, and therefore the chargeability of the toner is damaged at a relatively early stage. Moreover, the toner is attached to the toner bearing member and the friction charge member due to the contact pressure therebetween, by which toner charging performance is degraded and as a result, the life of the developing device becomes relatively short.

The developing device of the two-component development method supplies a toner from a magnetic brush of the developer retained on a developer bearing body to an electrostatic latent image on the image bearing body for performing development. Since a toner and a carrier which constitute the developer are charged to predetermined polarity by frictional contact therebetween in the developing device, the stress exerted to the toner is smaller than that in the case of the monocomponent developing device. Since the surface area of the carrier is larger than that of the toner, the carrier is free from becoming dirty due to adhesion of the toner. However, the two-component development method had an inconvenience, that is, when a magnetic brush is directly brought into contact with an image bearing body for carrying out development, the magnetic brush causes irregular sweeping, resulting in sliding noise generated in images.

From the viewpoint of taking advantage of both the monocomponent development method and the two-component development method, a developing device of a so-called hybrid developing method is described in JP 56-40862 A and JP 2006-308687 A, in which charging of toner is performed in two-component method involving small stress, while development of electrostatic latent images is performed in monocomponent development method in which fogging is relatively small. In this hybrid developing method, the toner with relatively large particle size tends to be selectively presented from the toner bearing body to the electrostatic latent image, and therefore when continuous printing is performed, the toner having relatively small particle size and charged to high potential tends to accumulate on the toner bearing body and to cause selective development, which fosters a tendency of lowering the density in images to be formed. Therefore, if there are a section (undeveloped section) where the toner was not presented for development and a section (developed section) where the toner was presented and consumed for development on the toner bearing body, only a low-charged toner, which is easily scraped in a mechanical manner by the magnetic brush on the developer bearing body, is collected among the toners in the undeveloped section, and a high-charged toner is left uncollected, while the toner with an average charge amount is newly supplied to the toner bearing body in the developed section from the magnetic brush. This causes such a problem as easy generation of a so-called hysteresis phenomenon in which some of the last developed image appear as an afterimage (memory image) at the time of next development. In a concrete example, when a rectangular gray halftone image 5 with a size large enough to contain a small rectangular black solid image 3 is formed next to the black solid image 3 as shown in FIG. 17A, a toner consumption area and a toner non-consumption area are generated on the toner bearing body, so that as shown in FIG. 17B, an afterimage 7 corresponding to the toner consumption area of the black solid image 3 appears in the halftone image 5.

An image forming apparatus disclosed in JP 2006-308687 A has a developing device composed of a magnetic roller and a developing roller. From developer containing a toner and a carrier retained on the peripheral face of the magnetic roller, only the toner is selectively supplied to the peripheral face of the developing roller, and an electrostatic latent image (electrostatic latent image section) on the photoconductor is developed using the toner retained on the peripheral face of the developing roller. In the invention of JP 2006-308687 A, the developer contains charged particles, which are present between the toner and the carrier without being retained on the surface of the toner nor the carrier, and which prevent pulverized toner powder from adhering to the surface of the carrier to form spent. However, the charged particles are contained only in the developer initially introduced to the developing device. Since the charged particles are not retained on the surface of the toner nor the carrier, some of them are supplied to the developing roller together with the toner because of their electric coupling with the toner, and then adhere to the nonimage section in an electrostatic latent image on the photoconductor where they are gradually consumed. Consequently, if a large quantity of an image with small image area ratio or small image ratio (so-called monochrome ratio), such as character images, are printed, then only the charged particles are consumed in large quantities, which causes a problem in obtaining the chargeability of the toner stable for a long time.

In order to solve the problem of the hysteresis phenomenon in the hybrid developing method mentioned above, it is necessary to improve toner recoverability from the toner bearing body or from the developing roller at the position after the developing area. To this end, it is possible to consider adjusting such conditions as placement of magnetic poles of the magnetic roller as a developer bearing body, developer transportation quantity, and distance to the developing roller, so as to increase the developer density between the developing roller and the magnetic roller in order to enhance the efficiency of toner recovery from the developing roller. However, when the developer density between both the rollers is increased, problems such as torque increase and heat generation by clogging of the developer arise.

In order to enhance the toner recoverability from the developing roller in the hybrid developing method, it has been proposed in JP 2003-280357 A to form an oscillating electric field between the developing roller and the magnetic roller, which acts in favor of toner recovery. However, this proposal impairs the original function, that is, to supply a toner from the magnetic roller to the developing roller. Accordingly, it has been proposed in JP 2005-10290 A to activate an electric field which electrically collects the toner on the developing roller at the time of non-image formation after the end of image forming operation. However, this causes a problem in which the carrier on the magnetic roller tends to be electrostatically adsorbed to the developing roller in connection with the complication of bias control and application of recovery bias.

SUMMARY OF THE INVENTION

An object of the present invention is to provide a developing device capable of eliminating the hysteresis phenomenon in the hybrid developing method, and an image forming apparatus using the same.

In order to accomplish the object, the present invention provides a developing device using developer containing a toner and a carrier to makes an electrostatic latent image on an electrostatic latent image bearing body into a visible image, comprising:

developer containing a toner and a carrier, the toner being charged to a first polarity by frictional contact between the toner and the carrier, while the carrier being charged to a second polarity which is different from the first polarity;

a first conveyance member which is rotationally driven;

a second conveyance member which faces the first conveyance member via a first region, which is rotationally driven so as to move to a direction opposed to the first conveyance member in the first region, and which faces the electrostatic latent image bearing body via a second region;

first electric field forming unit which forms a first electric field between the first conveyance member and the second conveyance member to move the toner in the developer retained by the first conveyance member to the second conveyance member; and second electric field forming unit which forms a second electric field between the second conveyance member and the electrostatic latent image bearing body to move the toner retained by the second conveyance member to an electrostatic latent image on the electrostatic latent image bearing body for making the electrostatic latent image into a visible image, wherein the first electric field is an oscillating electric field having both a function to supply the toner to the second conveyance member and a function to collect the toner from the second conveyance member while a time average field strength is biased to a side where the toner is supplied from the first conveyance member to the second conveyance member, and wherein a time ratio for carrying out a function to collect the toner from the second conveyance member to the first conveyance member is 60 to 80%.

According to the present invention, the above oscillating electric field is made to act between the first conveyance member and the second conveyance member, so that the toner can be efficiently collected from the second conveyance member without damaging the performance of toner supply from the first conveyance member to the second conveyance member, as a result of which the hysteresis phenomenon can be prevented.

In the developing device of the present invention, even in the case where the electric field of the toner supply direction is strengthened in order to separate charged particles having a polarity opposite to the toner from the toner, further addition of the charged particles to the developer (corresponding to claim 2) enables the charged particles retained on the carrier surface to impart the toner chargeability stable for a long time without deteriorating the recovery efficiency of the toner.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
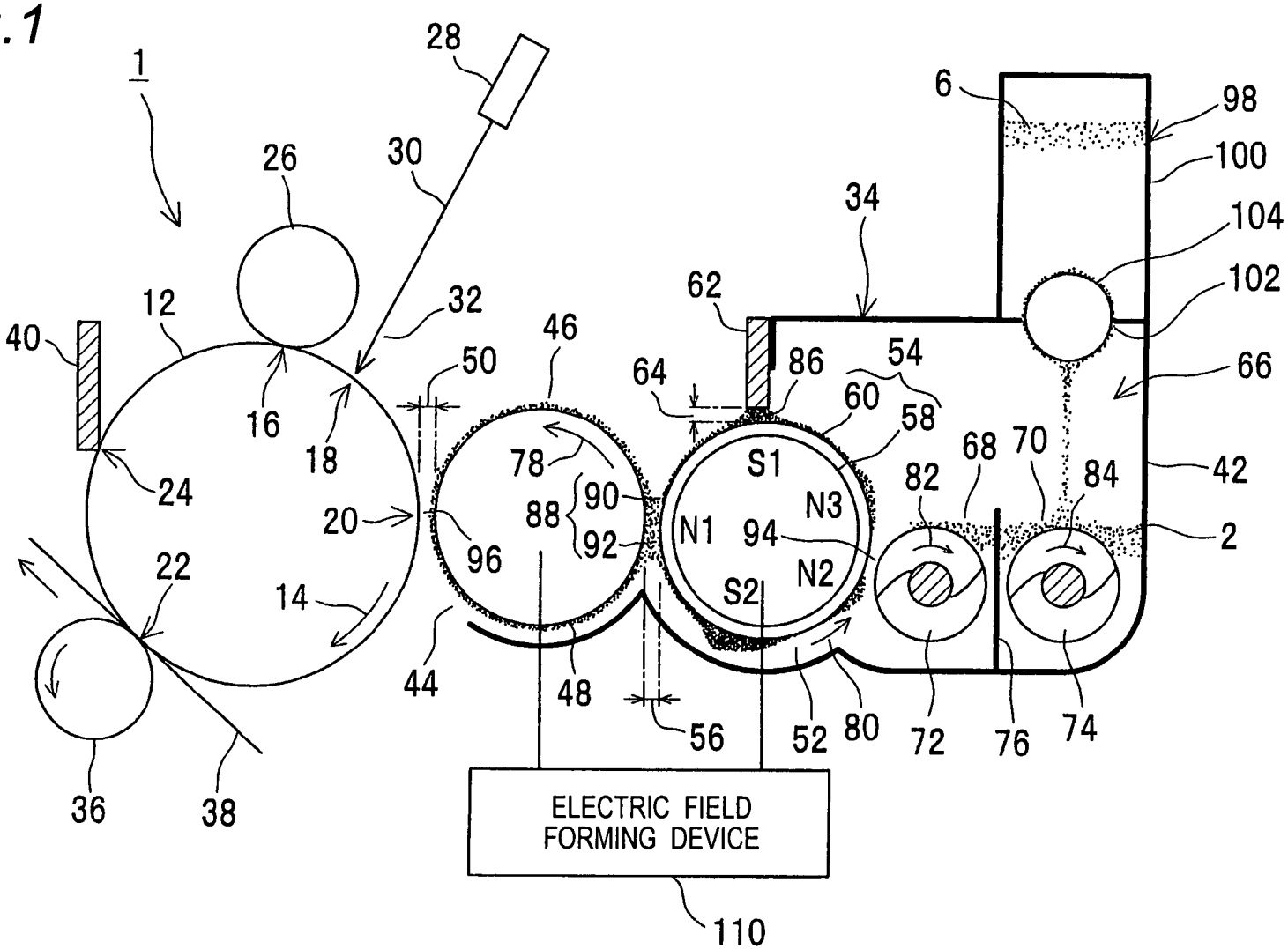
FIG. 1 is a view showing schematic structure of an image forming apparatus in the present invention and a cross section of a developing device in the present invention.

The preferred embodiments of the present invention will now be described with reference to the accompanying drawings. In the following description, terms indicating specific directions (e.g., "upper", "lower", "left", "right", other terms including these direction indicating terms, "clockwise direction", and "counterclockwise direction") are used. However, it should be understood that those terms are used for easy understanding of the invention with reference to the drawings and therefore the present invention is to be considered not restricted by the use of those terms. In an image forming apparatus and a developing device which will be explained hereinbelow, the like component members are designated by like reference numerals.

[1. Image Forming Apparatus]

FIG. 1 shows a section relevant to image formation by an electrophotographic image forming apparatus according to the present invention. The image forming apparatus may be any one of a copying machine, a printer, a facsimile, and a composite machine having those functions. The image forming apparatus 1 has a photoconductor 12 serving as an electrostatic latent image bearing body. In the embodiment, although the photoconductor 12 is constituted from a cylinder body, the present invention is not limited to such a form and an endless belt type photoconductor can be used instead. The photoconductor 12 is drive-connected to an unshown motor. The photoconductor 12 is rotated in the arrow 14 direction in accordance with the drive of the motor. Placed around the photoconductor 12 along the rotation direction of the photoconductor 12 are a charging station 16, an exposure station 18, a developing station 20, a transfer station 22, and a cleaning station 24.

The charging station 16 has a charging unit 26 for charging a photoconductor layer, which is the peripheral face of the photoconductor 12, to predetermined potential. Although the charging unit 26 is described as a roller in the cylindrical shape in the embodiment, charging units of other forms (e.g., a rotating or fixed brush-type charging unit, a wire-electrical discharge-type charging unit) can be used in place of the charging unit 26. The exposure station 18 has a passage 32 for image light 30 emitted from the exposure device 28 placed at a position in the vicinity of or distant from the photoconductor 12 to expose the peripheral face of the charged photoconductor 12. An electrostatic latent image, which is composed of a section where the potential was attenuated by projection of the image light and a section where the charged potential is maintained almost intact, is formed on the peripheral face of the photoconductor 12 after the exposure station 18. In the embodiment, the section with attenuated potential is an electrostatic latent image section, and the section with the charged potential maintained almost intact is the nonimage section in an electrostatic latent image. The developing station 20 has a developing device 34 which makes the electrostatic latent image into a visible image with use of powder developer. Details of the developing device 34 will be explained later. The transfer station 22 has a transfer device 36 for transferring the visible image formed on the peripheral face of the photoconductor 12 onto a sheet 38 such as paper and films. Although the transfer device 36 is described as a cylindrical shaped roller in the embodiment, transfer devices of other forms (e.g., wire-electrical discharge-type transfer device) can also be used. The cleaning station 24 has a cleaning device 40 for collecting the untransferred toner, which has not been transferred onto the sheet 38 in the transfer station 22 and remains on the peripheral face of the photoconductor 12, from the peripheral face of the photoconductor 12. Although the cleaning device 40 is described as a plate-shaped blade in the embodiment, cleaning devices of other forms (e.g., a rotating or fixed brush-type cleaning device) can also be used in place thereof.

During image formation by the image forming apparatus 1 having such a structure, the photoconductor 12 rotates clockwise in accordance with the drive of a motor (unshown). At this time, a photoconductor peripheral portion which passes the charging station 16 is charged to predetermined potential by the charging unit 26. The charged peripheral portion of the photoconductor 12 is exposed to the image light 30 by the exposure station 18, by which an electrostatic latent image is formed. The electrostatic latent image is conveyed to the developing station 20 with rotation of the photoconductor 12, where the image is visualized as a developer image by the developing device 34. The visualized developer image is conveyed to the transfer station 22 with rotation of the photoconductor 12, where the image is transferred onto the sheet 38 by the transfer device 36. The sheet 38 onto which the developer image was transferred is conveyed to an unshown fixing station, where the developer image is fixed to the sheet 38. The photoconductor peripheral portion which passed the transfer station 22 is conveyed to the cleaning station 24, where the developer remaining on the peripheral face of the photoconductor 12 without being transferred onto the sheet 38 is collected.

[2. Developing Device]

The developing device 34 has a housing 42 for housing two-component developer containing a nonmagnetic toner which is the first component particle and a magnetic carrier which is the second component particle, and various members explained below. A part of the housing 42 is deleted to simplify the drawing for easy understanding of the invention. The housing 42 has an opening 44 opened to the photoconductor 12, and a developing roller 48 serving as a toner conveyance member (second conveyance member) is provided in a space 46 formed near the opening 44. The developing roller 48 is a cylindrical member (second rotary cylindrical body), and is rotatably placed parallel to the photoconductor 12 with a predetermined development gap 50 interposed between the developing roller 48 and the peripheral face of the photoconductor 12.

Another space 52 is formed behind the developing roller 48. In the space 52, a conveying roller 54 serving as a developer conveyance member (first conveyance member) is placed parallel to the developing roller 48 with a predetermined supply/recovery gap 56 interposed between the conveying roller 54 and the peripheral face of the developing roller 48. The conveying roller 54 has an unrotatably fixed magnet body 58 and a cylinder sleeve 60 rotatably supported by the circumference of the magnet body 58. Above the sleeve 60, a regulating board 62 fixed to the housing 42 and extending parallel to the central axis of the sleeve 60 is placed facing the sleeve 60 with a predetermined regulation gap 64.

The magnet body 58 has a plurality of magnetic poles which face the inner surface of the conveying roller 54 and extend in the central axis direction of the conveying roller 54. In the embodiment, a plurality of the magnetic poles include a magnetic pole S1 which faces an upside inner peripheral face portion of the conveying roller 54 in the vicinity of the regulating board 62, a magnetic pole N1 which faces a lefthand side inner peripheral face portion of the conveying roller 54 in the vicinity of the supply/recovery gap 56, a magnetic pole S2 which faces the downside inner peripheral face portion of the conveying roller 54, and two homopolar magnetic poles N2, N3 which are adjacent to each other and face a right-hand side inner peripheral face portion of the conveying roller 54.

A developer stirring chamber 66 is formed behind the conveying roller 54. The stirring chamber 66 has a front chamber 68 formed in the vicinity of the conveying roller 54, and a rear chamber 70 which is separated from the conveying roller 54. A front screw 72, which is a front stirring conveyance member for conveying, while stirring, the developer from the surface of the drawing toward the back face thereof, is rotatably placed in the front chamber 68, whereas a rear screw 74, which is a rear stirring conveyance member for conveying, while stirring, the developer from the back face of the drawing toward the surface thereof, is rotatably placed in the rear chamber 70. As shown in the drawing, the front chamber 68 and the rear chamber 70 may be partitioned with a partition 76 set between both the chambers. In this case, a partition section in the vicinity of both ends of the front chamber 68 and the rear chamber 70 is removed to form an accessway, so that the developer which arrived at a downstream end section of the front chamber 68 is sent into the rear chamber 70 via the accessway, while the developer which arrived at a downstream end section of the rear chamber 70 is sent into the front chamber 68 via the accessway.

Figure 2:
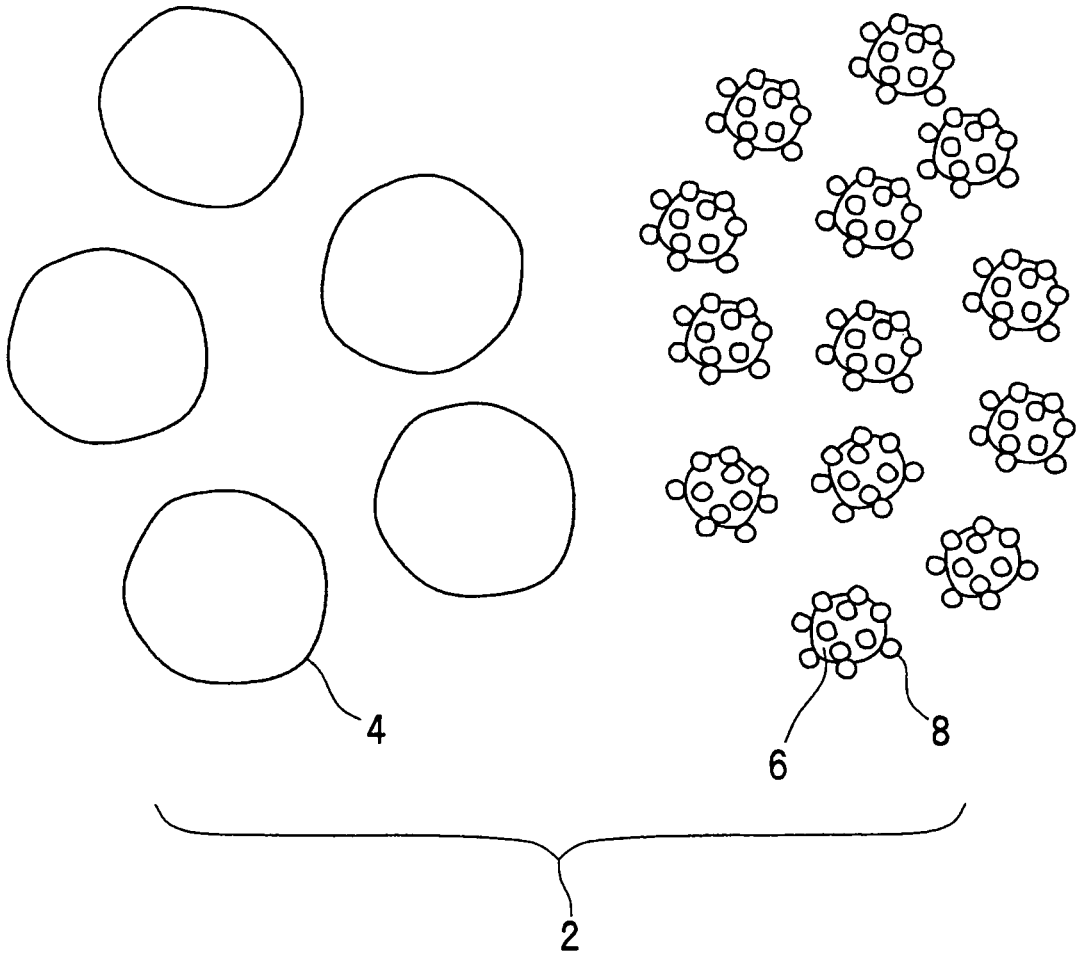
FIG. 2 is a view schematically explaining the composition of developer.
Figure 3:
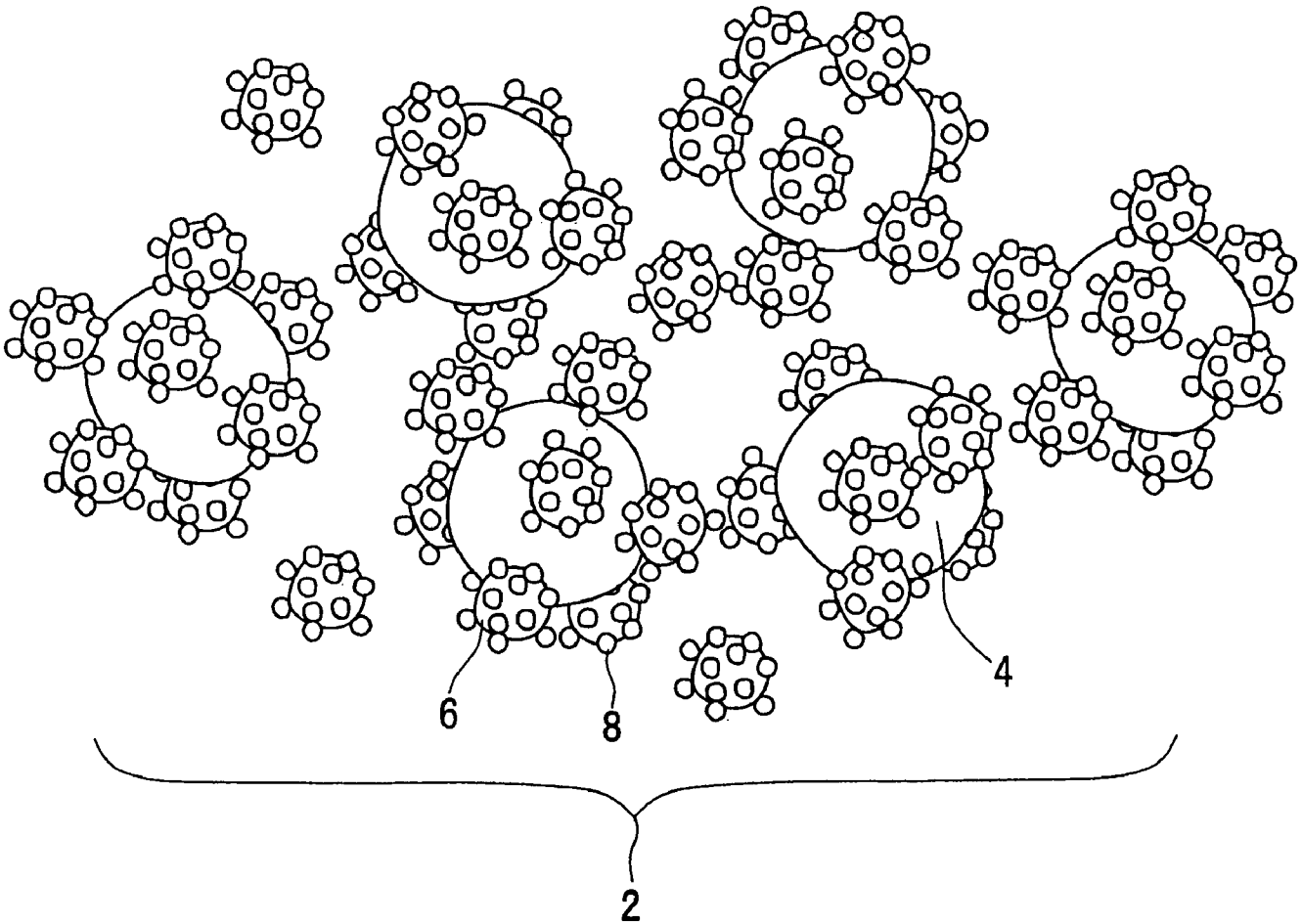
FIG. 3 is a view schematically showing the state where toners retaining charged particles adhere to the surface of the carrier.

Description will be given of the operation of the developing device 34 having such a structure. During image formation, the developing roller 48 and the sleeve 60 respectively rotate in arrows 78 and 80 directions in accordance with the drive of an unshown motor. The front screw 72 rotates in the arrow 82 direction and the rear screw 74 rotates in the arrow 84 direction. Consequently, the developer 2 accommodated in the developer stirring chamber 66 is stirred while being circulated between the front chamber 68 and the rear chamber 70. As a result, the toner and the carrier contained in the developer come into frictional contact with each other and are mutually charged to reverse polarities, respectively. According to the embodiment, the carrier shall be charged to positive polarity while the toner shall be charged to negative polarity. As shown in FIG. 2, a carrier 4 is fairly larger than a toner 6. Therefore, as shown in FIG. 3, the toner 6 charged to negative polarity adheres to the periphery of the carrier 4 charged to positive polarity mainly because of electric attraction between both the toner and the carrier.

With reference to FIG. 1 again, the charged developer 2 is supplied to the conveying roller 54 in the process of being conveyed through the front chamber 68 by the front screw 72. The developer 2 supplied from the front screw 72 to the conveying roller 54 is retained to the peripheral face of the sleeve 60 in the vicinity of the magnetic pole N3 by magnetism of the magnetic pole N3. The developer 2 retained by the sleeve 60 constitutes a magnetic brush along magnetic lines of force formed with a magnet body 58. The developer 2 is conveyed counterclockwise based on rotation of the sleeve 60. As for the developer 2 retained by the magnetic pole S1 in an opposite region (regulation field 86) of the regulating board 62, the amount allowed to pass the regulation gap 64 is limited to a specified amount by the regulating board 62. The developer 2 which passed the regulation gap 64 is conveyed to a region (supply/recovery region) 88 facing the magnetic pole N1, where the developing roller 48 and the conveying roller 54 face each other. As described in detail later, mainly in an upstream region (supply region) 90 with respect to the rotation direction of the sleeve 60 in the supply/recovery region 88, the toner 6 adhering to the carrier 4 is electrically supplied to the developing roller 48 by the existence of the electric field formed between the developing roller 48 and the sleeve 60. In contrast, mainly in a downstream region (recovery area) 92 with respect to the rotation direction of the sleeve 60 in the supply/recovery region 88, the toner on the developing roller 48 which has been returned to the supply/recovery region 88 without contributing to development is scraped by a magnetic brush formed along magnetic lines of force of the magnetic pole N1 and is collected by the sleeve 60 as described later. The carrier 4 is retained on the peripheral face of the sleeve 60 by the magnetism of the magnet body 58, which prevents the carrier 4 from moving from the sleeve 60 to the developing roller 48. The developer 2 which passed the supply/recovery region 88 is retained by the magnetism of the magnet body 58, and once the developer 2 passes an opposite section of the magnetic pole S2 and reaches an opposite region (release region 94) of the magnetic poles N2 and N3 with rotation of the sleeve 60, it is discharged from the peripheral face of the sleeve 60 to the front chamber 68 by a repulsive magnetic field formed by the magnetic poles N2 and N3, and is mixed with developer 2 conveyed through the front chamber 68.

The toner 6 retained on the developing roller 48 in the supply region 90 is conveyed counterclockwise with rotation of the developing roller 48, and adheres to an electrostatic latent image section formed on the peripheral face of the photoconductor 12 in a region (developing region) 96 where the photoconductor 12 and the developing roller 48 face each other. In the image forming apparatus of the embodiment, a predetermined negative-polarity potential $V_H$ is given to the peripheral face of the photoconductor 12 by the charging unit 26, and the electrostatic latent image section exposed to the image light 30 by the exposure device 28 attenuates to a predetermined potential $V_L$, while the nonimage section other than the electrostatic latent image not exposed to the image light 30 by the exposure device 28 maintains the charged potential $V_H$ mostly intact. Therefore, in the developing region 96, in response to the action of the electric field formed between the photoconductor 12 and the developing roller 48, the toner 6 charged to negative polarity flies and adheres to the electrostatic latent image section to visualize the electrostatic latent image as a developer image. It is to be noted that in the developing region 96, contact development may be performed in which the toner layer on the developing roller 48 comes into direct contact with the photoconductor 12.

Thus, when the toner 6 is consumed from the developer 2, the amount of toner corresponding to the consumed amount should preferably be supplied to the developer 2. To this end, the developing device 34 has an element to measure a mixing ratio of the toner and the carrier housed in the housing 42. A toner replenishing section 98 is provided above the rear chamber 70. The toner replenishing section 98 has a container 100 for housing the toner. An opening 102 is formed in the bottom of the container 100, and a replenishing roller 104 is placed in this opening 102. The replenishing roller 104 is drive-connected to an unshown motor, which is driven based on the output of the element to measure the mixing ratio of the toner and the carrier, so that the toner is dropped and replenished to the rear chamber 70.

[3. Electric Field Forming Unit]

In order to efficiently move the toner 6 from the sleeve 60 to the developing roller 48 in the supply region 90, the developing roller 48 and the sleeve 60 are electrically connected with an electric field forming device 110. Specified examples of a power supply is shown in FIGS. 5A to 9.

Figure 5A:
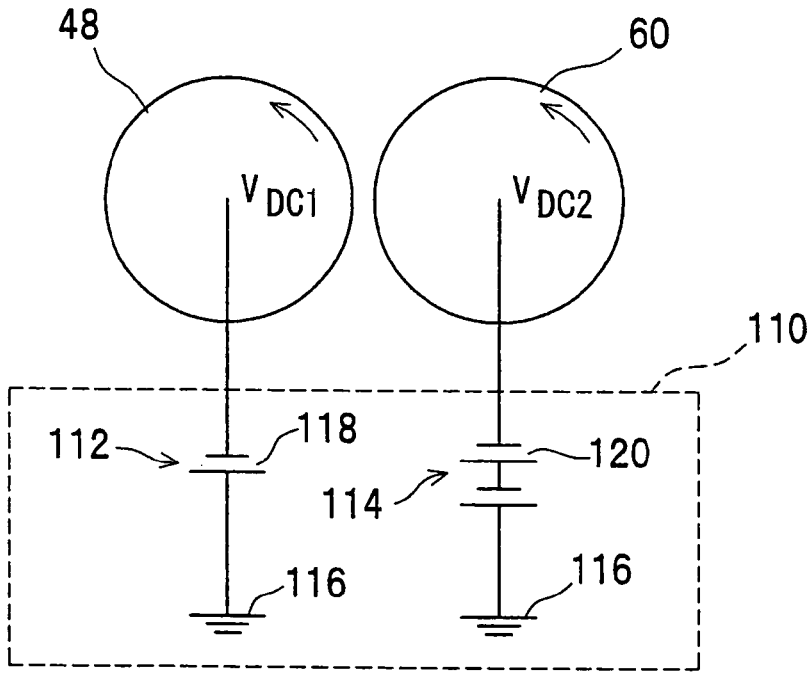
FIG. 5A is a view showing an electric field forming device in one embodiment.
Figure 5B:
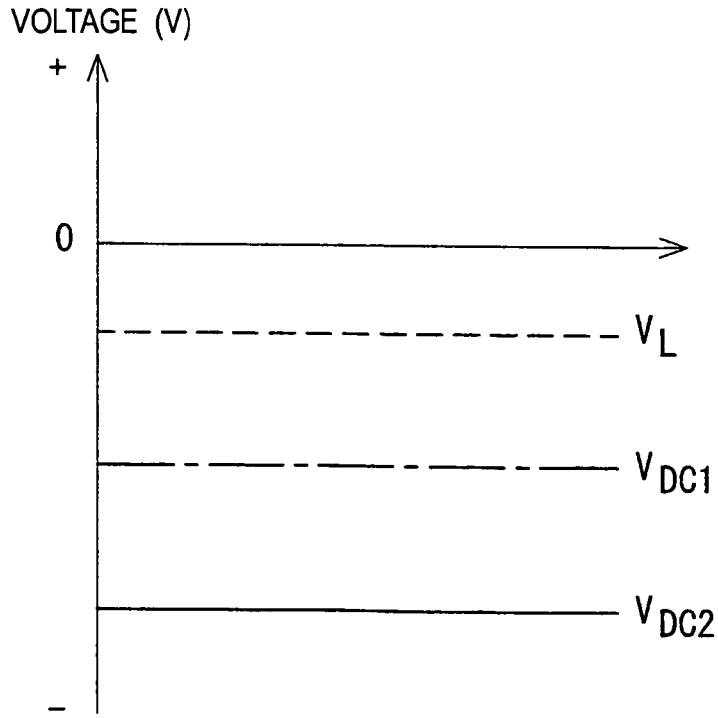
FIG. 5B is a view showing the relation of voltages supplied to a sleeve and a developing sleeve from the electric field forming device shown in FIG. 5A.

The electric field forming device 110 in a first example shown in FIG. 5A has a first power supply 112 (equivalent to a second electric field forming unit of claim. 2) connected to the developing roller 48, and a second power supply 114 (equivalent to a first electric field forming unit of claim. 1) connected to the sleeve 60. The first power supply 112 has a DC (Direct Current) power supply 118 connected to between the developing roller 48 and a ground 116 for applying a first DC voltage $V_{DC1}$ (e.g., −200 v) with a polarity identical to the charged polarity of the toner 6 to the developing roller 48. The second power supply 114 has a DC power supply 120 connected to between the sleeve 60 and the ground 116 for applying a second DC voltage $V_{DC2}$ (e.g., −400 v) with a polarity identical to the charged polarity of the toner 6 and higher than the first DC voltage to the sleeve 60. As a result, in the supply region 90, the toner 6 charged to negative polarity is electrically attracted from the sleeve 60 to the developing roller 48 in response to the action of the DC electric field formed between the developing roller 48 and the sleeve 60. At this time, the carrier 4 charged to positive polarity is not attracted from the sleeve 60 to the developing roller 48. In the developing area 96, the negative polarity toner retained on the developing roller 48 adheres to the electrostatic latent image section based on a potential difference between the developing roller 48 ($V_{DC1}$: −200 v) and the electrostatic latent image section ($V_L$: −80 v) as shown in FIG. 5B. At this time, the negative polarity toner does not adhere to the nonimage section other than the electrostatic latent image because of a potential difference between the developing roller 48 ($V_{DC1}$: −200 v) and the nonimage section other than the electrostatic latent image ($V_H$: −600 v).

Figure 6A:
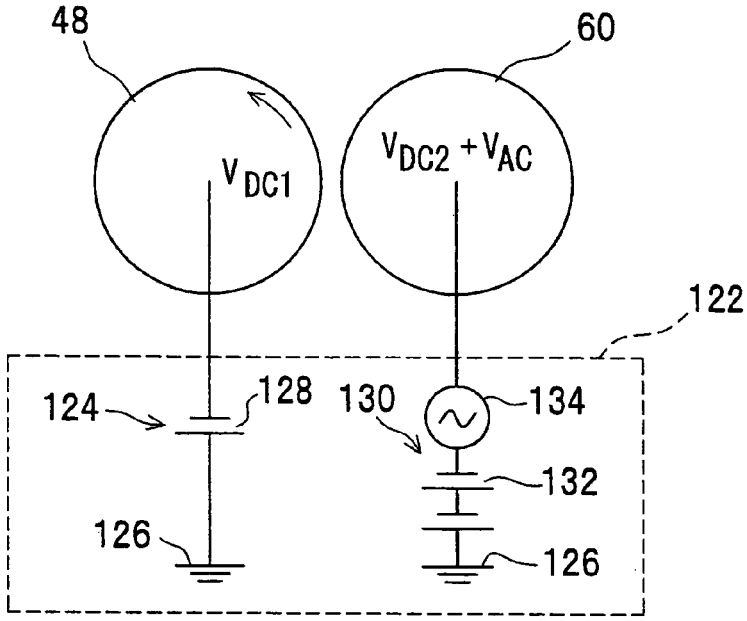
FIG. 6A is a view showing an electric field forming device in another embodiment.
Figure 6B:
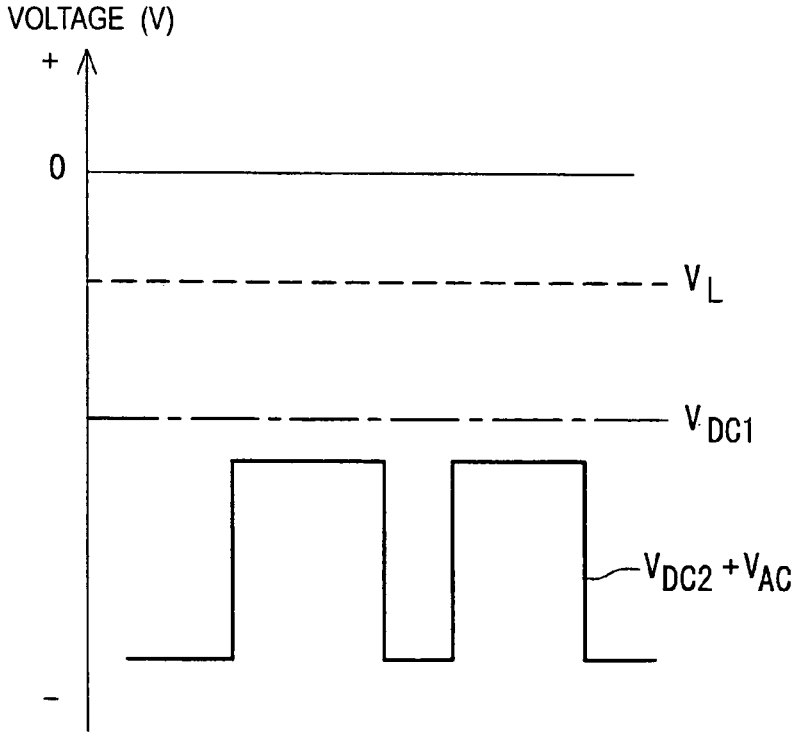
FIG. 6B is a view showing the relation of voltages supplied to a sleeve and a developing sleeve from the electric field forming device shown in FIG. 6A.

In an electric field forming device 122 in the second example shown in FIG. 6A, a first power supply 124 has a DC power supply 128 connected to between the developing roller 48 and a ground 126 like the power supply of the first example for applying a first DC voltage $V_{DC1}$ (e.g., −200 v) with a polarity identical to the charged polarity of the toner 6 to the developing roller 48. A second power supply 130 has a DC power supply 132 and an AC (Alternating Current) power supply 134 between the sleeve 60 and the ground 126. The DC power supply 132 applies a second DC voltage $V_{DC2}$ (e.g., −400 v) with a polarity identical to the charged polarity of the toner 6 and higher than the first DC voltage to the sleeve 60. As shown in FIG. 6B, the AC power supply 134 applies alternating voltage $V_{AC}$ having peak-to-peak voltage $V_{P-P}$ of, for example, 300 v to between the sleeve 60 and the ground 126. As a result, in the supply region 90, the toner 6 charged to negative polarity is electrically attracted from the sleeve 60 to the developing roller 48 in response to the action of the oscillating electric field formed between the developing roller 48 and the sleeve 60. At this time, the carrier 4 charged to positive polarity is retained on the sleeve 60 by the magnetism of the stationary magnet inside the sleeve 60 so as not to be supplied to the developing roller 48. In the developing area 96, the negative polarity toner retained on the developing roller 48 adheres to the electrostatic latent image section based on a potential difference between the developing roller 48 ($V_{DC1}$: −200 v) and the electrostatic latent image section ($V_L$: −80 v).

Figure 7A:
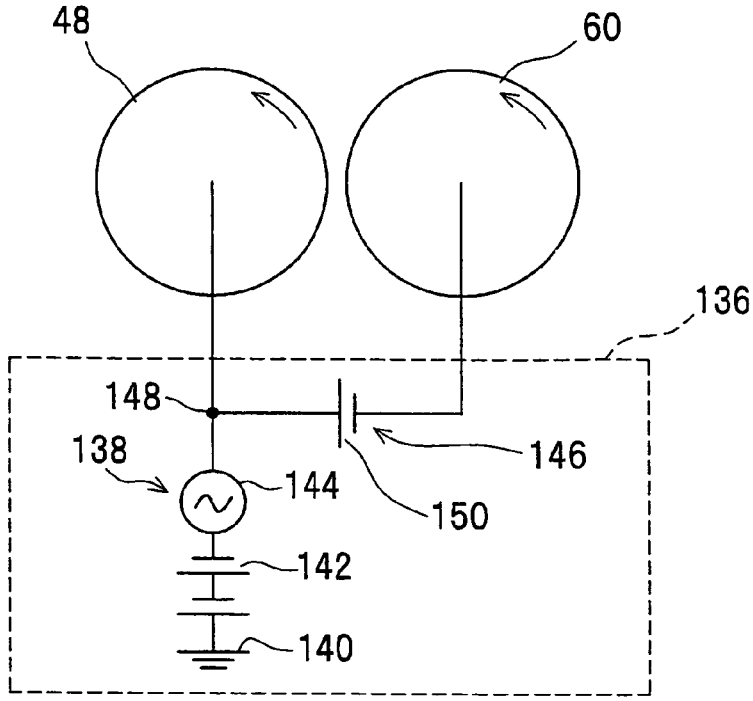
FIG. 7A is a view showing an electric field forming device in another embodiment.
Figure 7B:
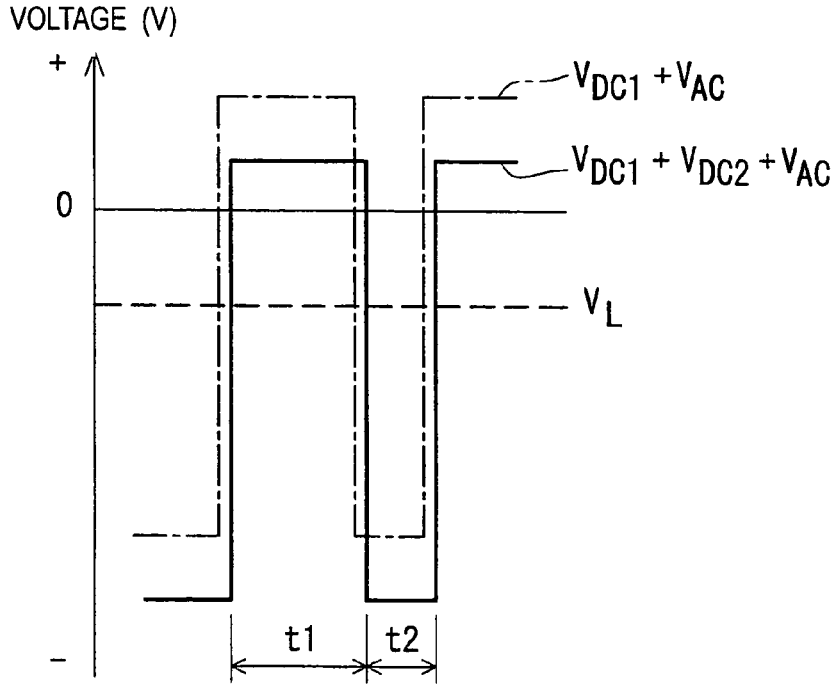
FIG. 7B is a view showing the relation of voltages supplied to a sleeve and a developing sleeve from the electric field forming device shown in FIG. 7A.

In an electric field forming device 136 shown in FIG. 7A, a first power supply 138 has a DC power supply 142 and an AC power supply 144 between a developing roller 48 and a ground 140. The DC power supplies 142 applies a first DC voltage $V_{DC1}$ (e.g., −200 v) with a polarity identical to the charged polarity of the toner 6 to the developing roller 48. The AC power supply 144 applies alternating voltage $V_{AC}$ having an amplitude (peak-to-peak voltage) $V_{P-P}$ of, for example, 1600 v to between the developing roller 48 and the ground 140. The second power supply 146 has a DC power supply 150 connected to between a terminal 148 between the developing roller 48 and the AC power supply 144 and the sleeve 60. The DC power supply 150 can output a predetermined DC voltage $V_{DC2}$, with its anode being connected to the terminal 148 and its cathode being connected to the sleeve 60. Consequently, the sleeve 60 is biased to negative polarity with respect to the developing roller 48 (see FIG. 7B). As a result, in the supply region 90, the toner 6 charged to negative polarity is electrically attracted from the sleeve 60 to the developing roller 48 in response to the action of the oscillating electric field formed between the developing roller 48 and the sleeve 60. In the developing area 96, the negative polarity toner on the developing roller 48 adheres to the electrostatic latent image section based on a potential difference between the developing roller 48 ($V_{DC1}$: −200 v) and the electrostatic latent image section ($V_L$: −80 v). It is to be noted that in FIG. 7B, the applied voltage to the developing roller 48 and the applied voltage to the sleeve 60 are illustrated in the state of being slightly displaced to a time base direction (longitudinal direction) for easy understanding.

Figure 8:
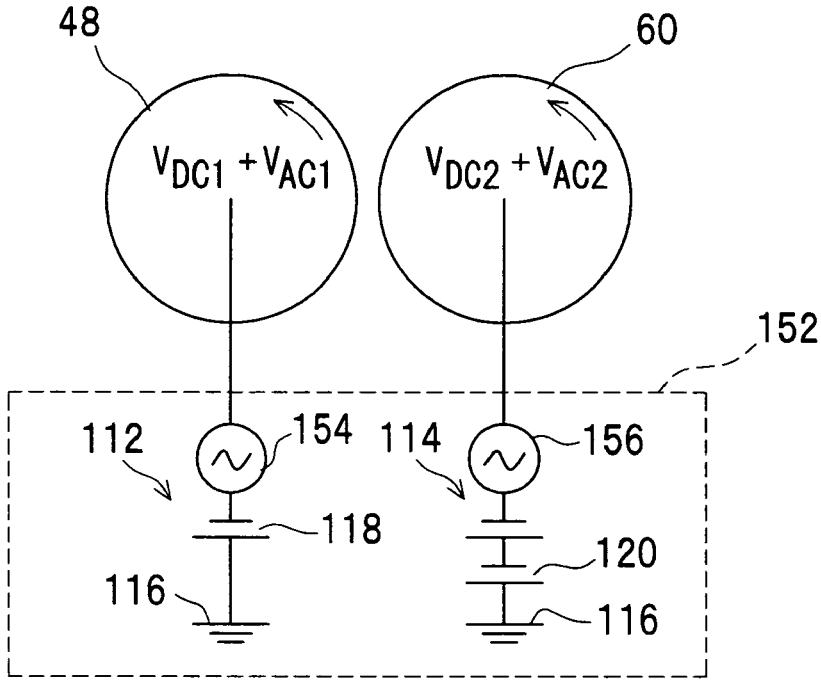
FIG. 8 is a view showing an electric field forming device in another embodiment.
Figure 9:
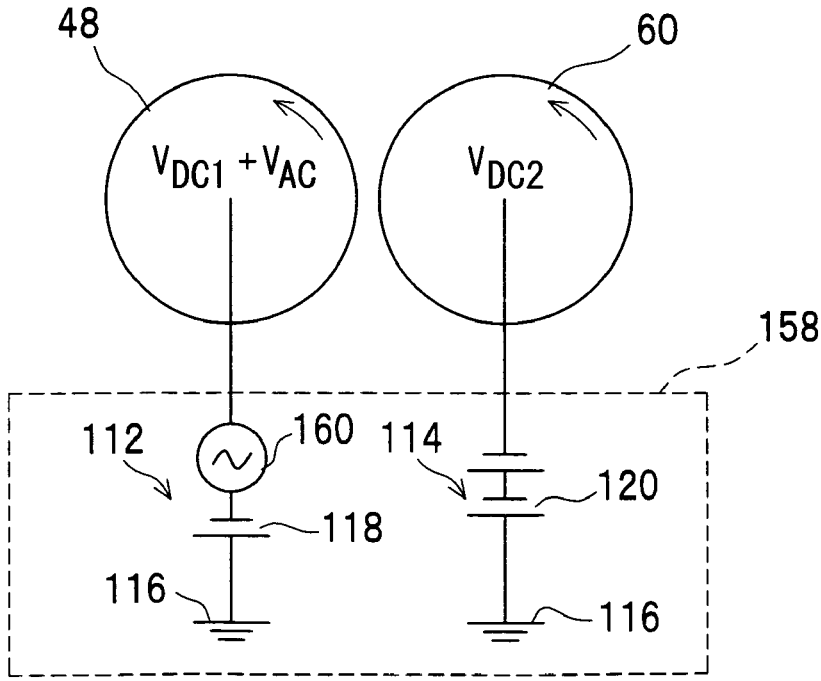
FIG. 9 is a view showing an electric field forming device in another embodiment.

A power supply 152 shown in FIG. 8 is structured by respectively adding AC electric field forming devices 154, 156 to the first power supply 112 and the second power supply 114 in the power supply of the first example shown in FIG. 5A. The output voltages of the AC electric field forming devices 154, 156 are $V_{AC1}$ and $V_{AC2}$. The value and the cycle of voltages $V_{AC1}$ and $V_{AC2}$ may be identical or may differ from each other. An electric field forming device 158 shown in FIG. 9 is structured by adding an AC power supply 160 to the first power supply 112 in the power supply of the first example shown in FIG. 5A. The output voltage of the AC power supply 160 is $V_{AC}$. In these electric field forming devices 152, 158 as with the power supplies 110, 122, 136, the toner 6 charged to negative polarity is supplied from the sleeve 60 to the developing roller 48 in the supply region 90 in response to the action of the oscillating electric field formed between the developing roller 48 and the sleeve 60, whereas the toner charged to negative polarity is supplied from the developing roller 48 to the electrostatic latent image section in the developing area 96 based on a potential difference between the developing roller 48 and the electrostatic latent image section ($V_L$: −80 v)

[4. Bias (Voltage) to be Applied]

Figure 10:
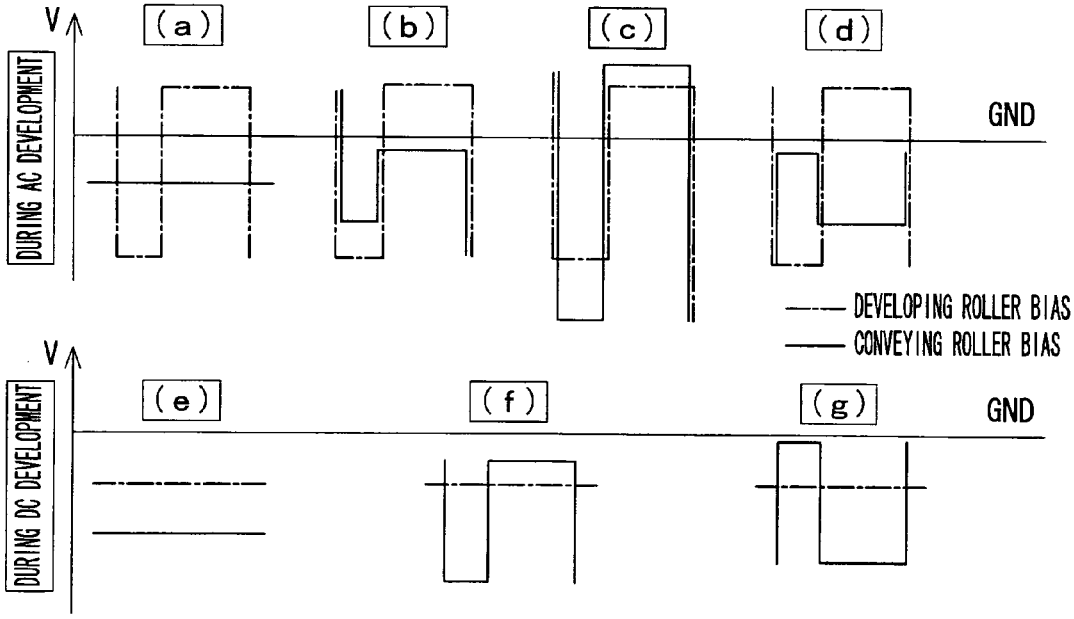
FIG. 10 is a waveform chart showing various combinations of a developing roller bias and a conveying roller bias, in which waveforms (c) and (f) among waveforms (a) to (g) are the waveforms according to the present invention.

Description is now given of the conditions of bias application, that is the key point of the present invention. FIG. 10 shows combinations of biases applied to the developing roller 48 and to the conveying roller 54 (i.e., sleeve 60) in the case where reversal development is performed with the toner 6 of negative polarity. Herein, the term "GND" denotes a ground potential, i.e., 0 v. In the cases (a) to (d), biases (hereinafter referred to as "developing biases") applied to the developing roller 48 are rectangular-wave oscillating voltages (AC voltages) having a predetermined duty ratio, while in the cases (e) to (g), developing biases are DC voltages. Herein, the bias (hereinafter referred to as "conveying roller bias") applied to sleeve 60 and the developing bias need to have the potential relation which can supply the toner 6 to the developing roller 48 from the sleeve 60, and which can supply the toner 6 to the electrostatic latent image section on the photoconductor 12 from the developing roller 48.

Figure 11:
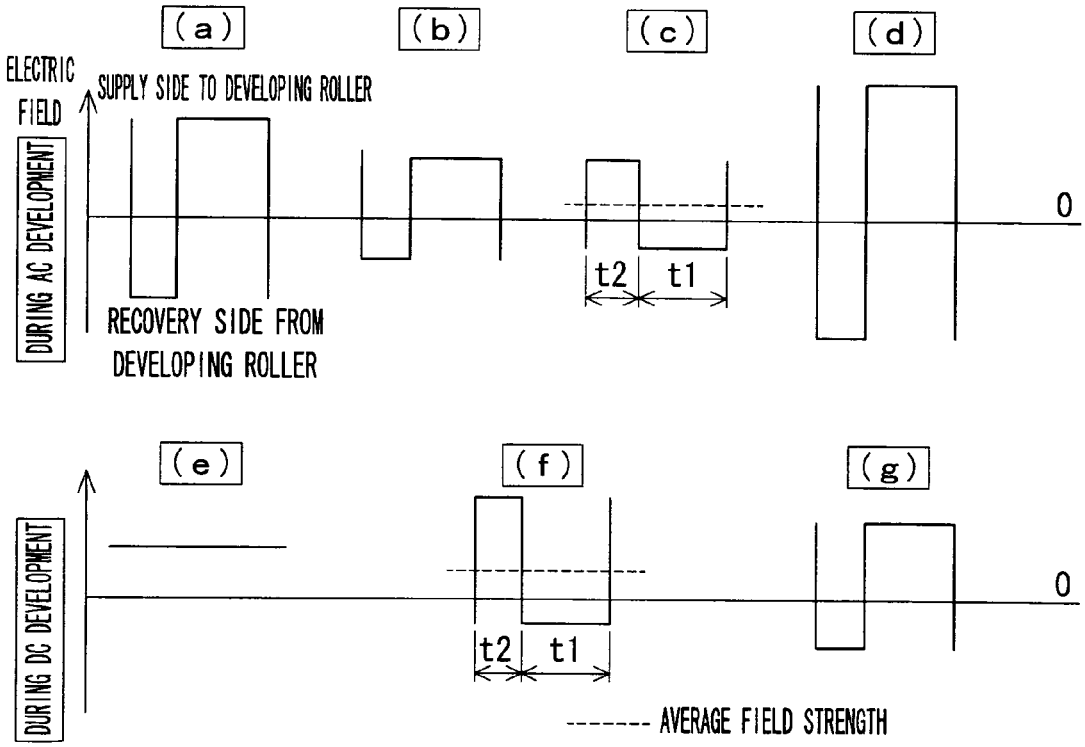
FIG. 11 is a waveform chart corresponding to FIG. 10 for showing various electric fields acting on a supply/recovery region, in which waveforms (c) and (f) among waveforms (a) to (g) are the waveforms according to the present invention.

FIG. 11 shows an electric field which acts on the toner 6 in the supply/recovery region 88 upon application of the developing bias and the conveying roller bias. In the drawing, the cases (a) to (g) respectively correspond to the cases (a) to (g) in FIG. 11. In FIG. 11, the upper side above the position 0 of the vertical axis is an electric field which acts in the direction of supplying the toner 6 to the developing roller 48, while the lower part below the position 0 is an electric field which acts in the direction of collecting the toner 6 from the developing roller 48. The electric fields (a) to (g) are roughly divided into three types, that is, the electric field (e) is a DC electric field, the electric fields (a), (b), (d), and (g) are oscillating electric fields in which the time ratio of the recovery direction from the developing roller 48 is relatively shorter than that of the supply direction, and the electric fields (c) and (f) are oscillating electric fields in which the time ratio of the recovery direction from the developing roller 48 is relatively long. Here, in the case of the DC electric field as in the case (e), an electric field which supplies the toner 6 is formed, although an electric field functioning time in the recovery direction does not exist. Accordingly, recovery of the developer toner on the developing roller 48 depends only on the mechanical scraping function by a magnetic brush on the conveying roller 54, which causes the problem of the hysteresis phenomenon mentioned above. In JP 2003-280357 A and JP 2005-10290 A, application of the biases shown in the cases (a), (b), (d), and (g) are described in the embodiments for the purpose of eliminating the hysteresis phenomenon.

On the contrary, the inventors of the present invention have found out specific conditions which make it possible to efficiently collect the developer toner on the developing roller 48 without enhancing the field strength in the recovery direction by activating the oscillating electric field having a relatively large recovery direction time ratio as shown in the cases (c) and (f). Herein, dotted lines shown in the cases (c) and (f) show time average field strength. By setting the time average field strength biased to the toner supply side with respect to the zero level, the performance to supply toner to the developing roller 48 is guaranteed. The time average field strength is a boundary of the oscillating electric field shown as a rectangular waveform or an AC waveform, and an upper area and a lower area within the waveform line divided by this boundary line are equal. The time ratio of the recovery electric field which acts in the direction of collecting the toner from the developing roller 48 (hereinafter also referred to as the recovery side duty ratio) is set to $t1/(t1+t2)\times 100$ [%].

Description is now given of the relation between the electric field waveform in the supply/recovery region 88 and the recoverability of the development residual toner not presented for development and remaining on the developing roller 48.

The development residual toner attached and retained onto the developing roller 48 receives the force in the direction of departing from the developing roller 48 by the action of the recovery direction electric field. If the force exceeds adhesion to the developing roller 48, then the developer toner is detached from the developing roller 48, which helps the magnetic brush on the conveying roller 54 to collect the developer toner. In order to prevent damage on the function to supply toner to the developing roller 48 while electrically imparting the separating force, it is possible to activate a strong recovery electric field in a time shorter than the supply electric field as disclosed in JP 2003-280357 A and JP 2005-10290 A. However, since both the supply electric field and the recovery electric field are strong, the problem of leak (breakdown) in the supply/recovery region 88 tends to arise.

Accordingly, the inventors of the present invention presumed that a part of the developer toner is detached in the recovery electric field and then the toner which has flown toward the conveying roller 54 is made to collide with the surface of the developing roller 48 by the function of the supply electric field in the reversed moving direction, so that kinetic energy of the toner which has flown is given to the development residual toner on the developing roller 48, by which it becomes possible to efficiently detach the development residual toner from the developing roller 48. This presumed phenomenon is hereinafter called "pumping." In this presumption, it is considered that pumping is not performed efficiently under the conditions (e.g., considerably long recovery time) in which the toner once detached does not return to the developing roller 48. On the contrary, under the conditions in which the recovery time is short, the travel distance of the detached toner is too short, and so the amount of kinetic energy generated when the toner is once again returned to the developing roller 48 is small, so that it is considered that the pumping is not promoted. It is further considered that at the point of time when the toner which has returned to the developing roller 48 collides with the development residual toner and supplies kinetic energy, the electric field changes to a recovery electric field, so that more efficient toner detachment can be performed. That is, it is presumed that there is an optimal range for the time ratio for functioning of the recovery direction electric field and the supply direction electric field and that efficient pumping is not performed if the time ratio is too small or too large.

As a result of a later-described experiment conducted in accordance with the presumed mechanism, particularly high recovery efficiency could be obtained when the time ratio for functioning of the recovery electric field in 1 cycle time of the oscillating electric field was 60% to 80%, which proved the validity of the above presumption.

[5. Developer]

Generally, the two-component developer containing a toner and a carrier as main components suffer contamination (i.e., spent) caused by the toner adhering to the surface of the carrier, which reduces the life of the carrier. Accordingly, in the present embodiment, in order to solve this problem, a charged particle (implanted particle) is added as a third component to the two-component developer.

Figure 4:
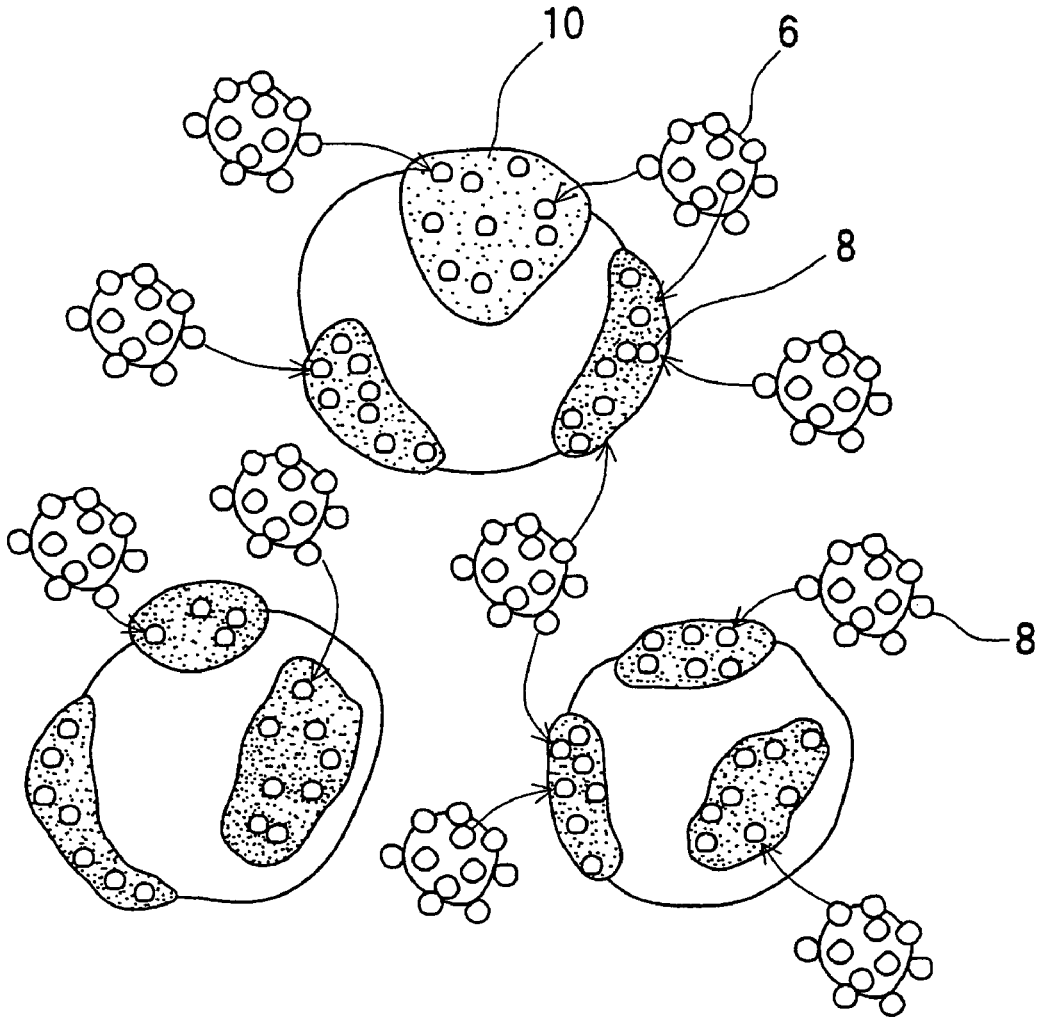
FIG. 4 is a view schematically showing the state where the charged particles are implanted into the surface of the carrier with spent adhering thereto.

As described specifically with reference to FIGS. 2 to 4, an image forming apparatus and a developing device of the present invention include a toner 6 and a carrier 4 as well as a charged particle 8 which is smaller than the toner 6 and which charges the toner 6 to regular polarity (negative polarity in the embodiment) by frictional contact with the toner 6. In the embodiment, the charged particles 8 are retained detachably on the peripheral face of the toner 6, and are supplied with the toner 6 from the toner replenishing section 98.

At the time of image formation, the charged particle 8 is conveyed together with the toner 6 and the carrier 4 within the housing 42, and then travels through the regulation field 86, the supply/recovery region 88, and the release region 94 in the state of being retained on the sleeve 60. In this conveyance process, when the charged particle 8 retained on the surface of the toner 6 and charged to positive polarity is placed in an electric field of the supply/recovery region 88, it is separated from the peripheral face of the toner 6 in response to the electric force of the direction opposite to the electric force acting on the toner 6. The separated charged particle 8 is retained on or implanted into the peripheral face of the carrier 4 due to stress exerted on between the separated charged particle 8 and the carrier 4. As shown in FIG. 4, when a part of or the entire peripheral face of the carrier 4 is covered with a spent 10, the charged particle 8 is retained onto and/or implanted into the spent 10. The charged particle 8 which was retained and/on or implanted into the peripheral face of the carrier 4 is charged to the polarity opposite to the polarity of the toner 6 by frictional contact with the toner 6. In the embodiment, since the toner 6 is charged to negative polarity, the charged particle 8 is charged to positive polarity. As a result, even if at least a part of the peripheral face of the carrier 4 with the charged particle 8 implanted therein is covered with the spent 10, the carrier 4 maintains the chargeability identical to that in the case without the spent 10 so as to charge the toner 6 to predetermined polarity.

Figure 12:
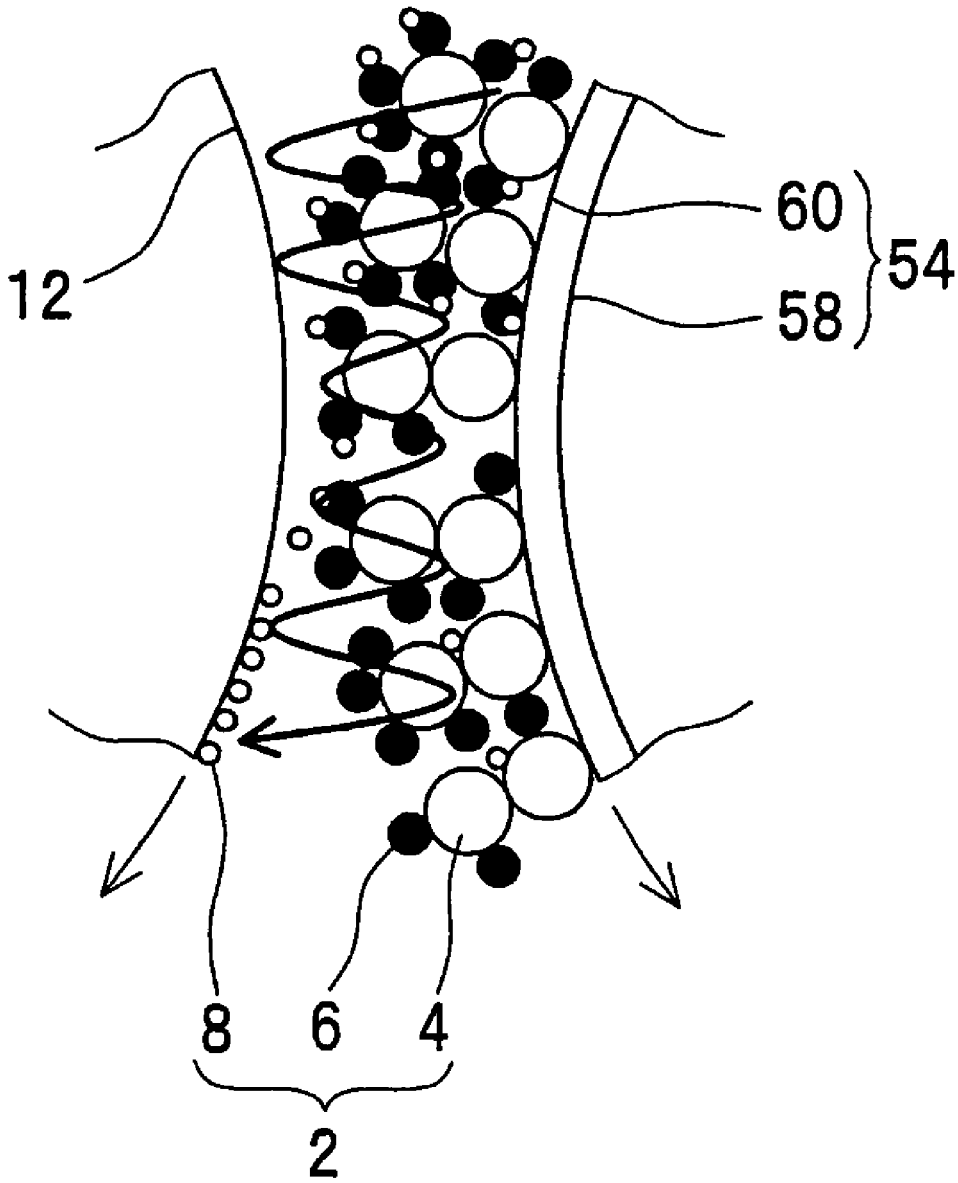
FIG. 12 is a view schematically showing the motion of the toners and the charged particles in the supply/recovery region.

As mentioned above, the charged particle 8 is charged to a polarity opposite to that of the toner 6. Accordingly, as shown in FIG. 12, in the supply/recovery region 88, the toner 6 moves to the developing roller 48 from the sleeve 60 based on the electric field formed between the developing roller 48 and the sleeve 60. The charged particle 8 separated from the toner 6 is quickly retained on the carrier surface of developer which has become relatively rich in carrier because the toner 6 has been taken away in the supply region 90. As a result, the charged particle 8 is not supplied together with the toner 6 to the developing roller 48, or the amount thereof is very small even if it is supplied to the developing roller 6.

Figure 13:
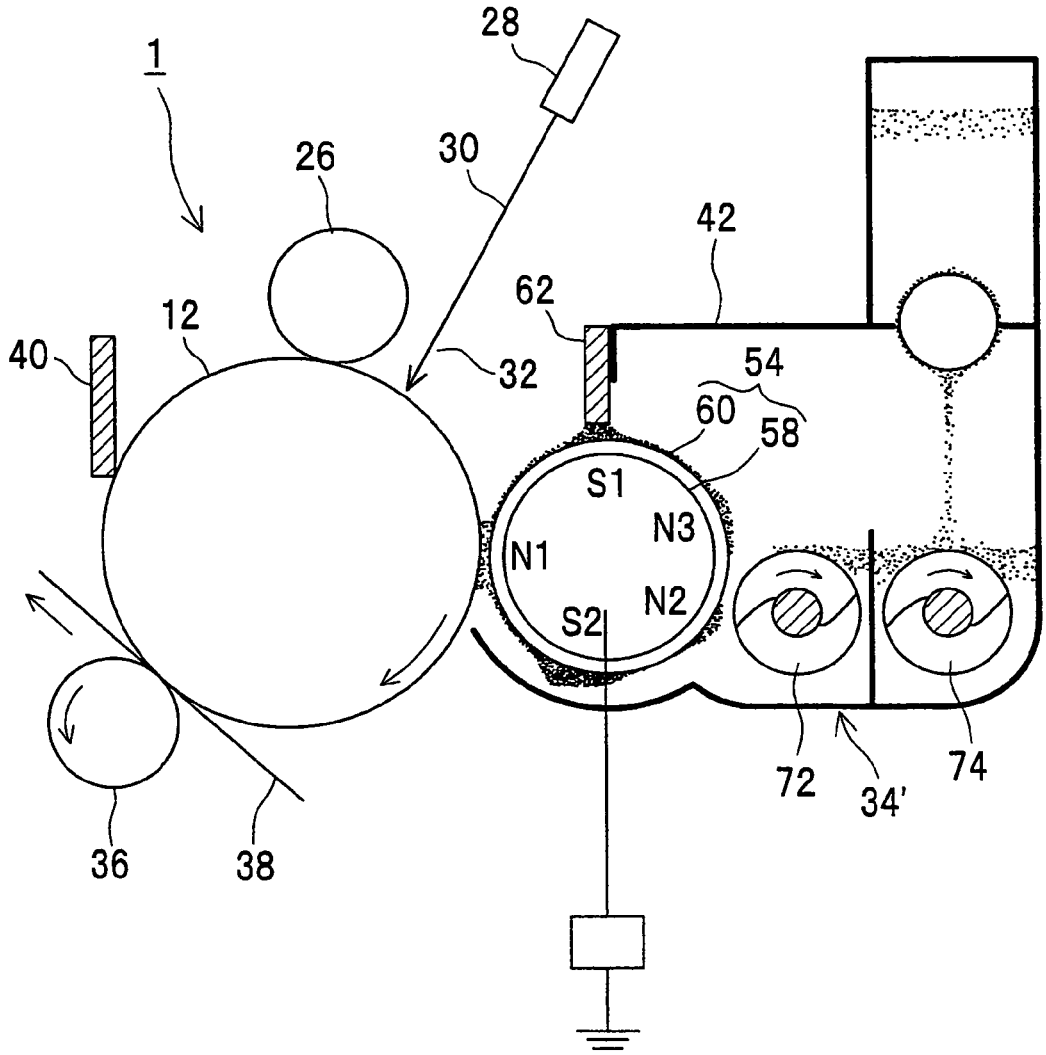
FIG. 13 is a cross sectional view showing a developing device in another form with a developing device being deleted from the developing device of FIG. 1, and showing the schematic structure of an image forming apparatus including the same.
Figure 14:
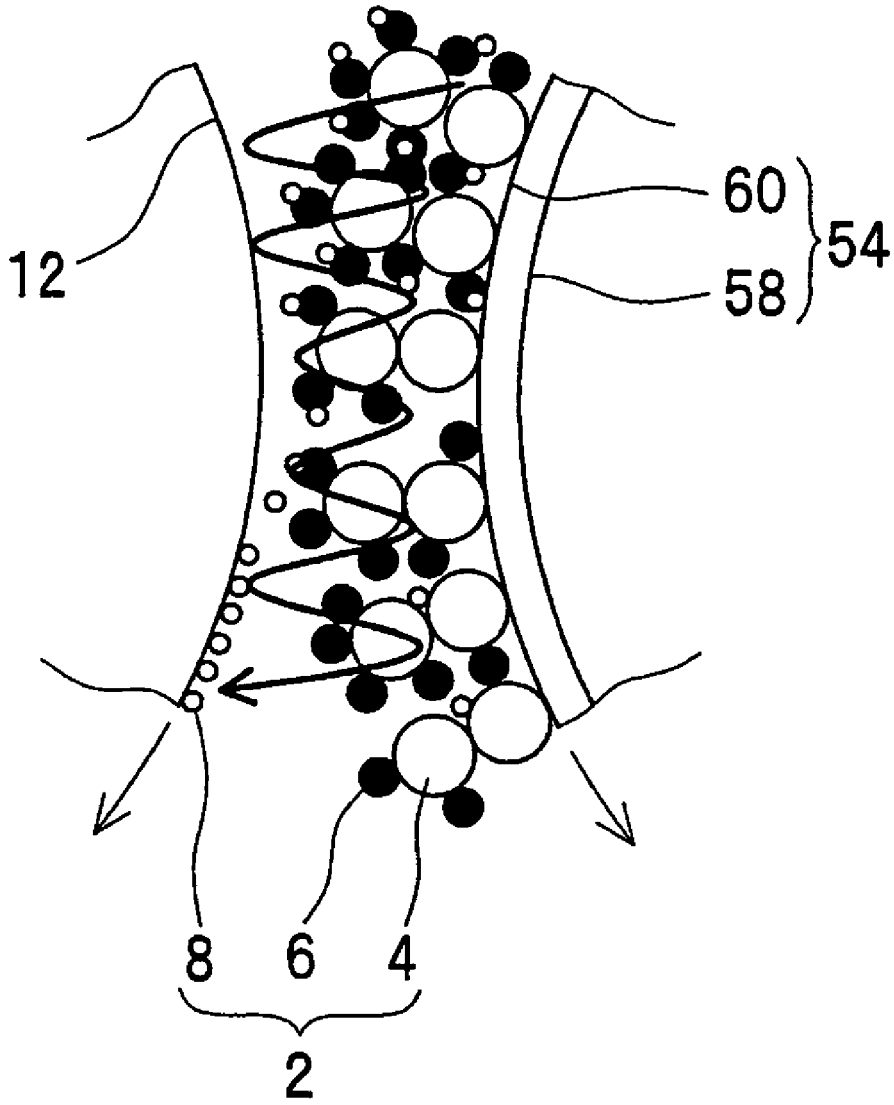
FIG. 14 is a view schematically showing the motion of the toners and the charged particles in a developing area in the developing device shown in FIG. 13.

As shown in FIG. 13, in the case where the same charged particle is used in a developing device 34' structured by removing the developing roller from the developing device shown in FIG. 1, the different result is brought about. Concretely, an electrostatic latent image is formed on the peripheral face of the photoconductor 12 facing a conveying roller 54 of the developing device 34'. The electrostatic latent image has, for example, a high potential nonimage section other than the electrostatic latent image which maintains charged potential mostly intact, and a low potential electrostatic latent image section in which the potential is attenuated by light 30 projected by the exposure device 28, and these high potential nonimage section other than the electrostatic latent image and low potential electrostatic latent image section run past an opposite section of the conveying roller 54. At the time of image formation, in the developing region, the toner 6 charged to, for example, negative polarity adheres not to the nonimage section other than the electrostatic latent image but to the low potential electrostatic latent image section. However, the charged particles 8 for charging the toner 6 to negative polarity is itself charged to positive polarity. Therefore, the charged particle 8 which is in the free state in the developing region adheres to the nonimage section other than the electrostatic latent image as shown in FIG. 14. Thus, according to the developing device 34', the charged particle 8 separated from the toner 6 is consumed in large quantity in the developing region by the nonimage section other than the electrostatic latent image of the photoconductor 12. As a result, there are very few charged particles 8 implanted into the peripheral face of the carrier 4 compared with the developing device 34, and therefore the carrier 4 with the spent adhered thereto cannot have sufficient toner charging performance.

Further, in the developing device explained in the above-mentioned JP 2006-308687 A, the charged particle exists in the relatively free state between both the surfaces of the toner and the carrier without being retained on the surfaces of the toner and the carrier. The charged particle initially introduced to the developing device is charged to a polarity opposite to the charged polarity of the toner. Therefore, after electrically coupled with the toner and supplied to the developing roller together with the toner, the charged particle adheres to the nonimage section other than the electrostatic latent image on the photoconductor and gradually disappears, with which the chargeability of the toner deteriorates. However, in the developing device of the present invention, the charged particle 8 separated from the toner 6 is quickly retained by the carrier 4 in the supply/recovery region 88 and stays on the peripheral face of the sleeve 60. Consequently, the charged particle 8 is almost not supplied to and consumed in the photoconductor 12 via the developing roller 48 like the toner 6, so that the chargeability of the toner which is stable for a long period of time can be obtained. However, although some charged particles 8 are still supplied to the developing roller 48 together with the toner 6 in this embodiment, new charged particles 8 are supplied from a replenishing section 98 together with the toner and never become extinct. This makes it possible to obtain the chargeability of the toner which is stable for a long period of time.

It is to be noted that in the embodiment, the toner 6 is charged to negative polarity while the carrier 4 is charged to positive polarity by frictional contact of the toner 6 and the carrier 4. The charged particle 8 charges the toner to negative polarity by contact with the toner 6, while the charged particle 8 is charged to positive polarity. The chargeability of the toner, the carrier, and the charged particle used in the present invention are not restricted to such a combination. Alternatives include a combination in which the toner 6 is charged to positive polarity while the carrier 4 is charged to negative polarity by frictional contact of the toner 6 and the carrier 4, and the charged particle 8 charges the toner to positive polarity by contact with the toner 6, while the charged particle 8 is charged to negative polarity.

[5. Specific Material]

Description is given of the concrete materials of the toner, the carrier, the charged particle, and other particles contained in the developer.

(Charged Particle)

Preferable charged particles for use are suitably chosen corresponding to the charged polarity of the toner. The number average particle size of the charged particle is 100-1000 nm for example. In the case of using the toner charged to negative polarity by frictional contact with the carrier, a particulate charged to positive polarity by contact with the toner is used as the charged particle. Such particulates can be constituted from inorganic particulates such as titanic acid strontium, barium titanate, titanic-acid calcium and alumina, and thermoplastics or thermosetting resin such as acrylic resin, benzoguanamine resin, nylon resin, polyimide resin and polyamide resin. The resin which constitutes the particulates may contain a positive charge control agent which is charged to positive polarity by contact with the toner. As the positive charge control agent, nigrosine dye, quarternary ammonium salt and the like can be used for example. The charged particle may be constituted from nitrogen-containing monomer. Examples of the material which constitutes the nitrogen-containing monomer include acrylic-acid 2-dimethylaminoethyl, acrylic-acid 2-diethylamino ethyl, methacrylic-acid 2-dimethylaminoethyl, methacrylic-acid 2-diethylamino ethyl, vinyl pyridine, N-vinyl carbazole, and vinyl imidazole.

In the case of the toner charged to positive polarity by frictional contact with the carrier, a particulate charged to negative polarity by contact with the toner is used as the charged particle. Usable as such a particulate include particulates constituted from, for example, inorganic particulates such as silica and titanium oxide, and thermoplastics or thermosetting resin such as fluororesin, polyolefin resin, silicone resin and polyester resin. A negative charge control agent charged to negative polarity by contact with the toner may be contained in the resin which constitutes the charged particle. Usable negative charge control agents include, for example, salicylic-acid-based and naphthol-based chromium complex, aluminum complex, iron complex, and zinc complex. The charged particle may be a copolymer of fluorine-containing acrylic-based monomer or fluorine-containing methacrylic-based monomer.

In order to control chargeability and hydrophobicity of the charged particle, the surface treatment may be applied to the surface of the inorganic particulate with use of silane coupling agents, titanium coupling agents, silicone oil and the like. Particularly in the case of imparting the positive chargeability to the inorganic particulate, it is preferred to conduct the surface treatment with use of amino group-containing coupling agents. In the case of imparting the negative chargeability to the particulate, it is preferred to conduct the surface treatment with use of fluorine group-containing coupling agents.

(Toner)

Publicly known toners conventionally used in general in the image forming apparatus can be used as toner. The toner particle size is, for example, about 3-15 micrometers. The toner containing coloring agents in binder resin, the toner containing charge control agents or release agents, and the toner retaining additives on its surface can also be used.

The toner can be manufactured by publicly known methods such as the grinding method, the emulsion-polymerization method, and the suspension-polymerization method.

(Binder Resin)

The binder resin used for the toner, which is not restrictive, may be, for example, styrene-based resin (single polymer or copolymer containing styrene or styrene derivative substitution), polyester resin, epoxy system resin, vinyl chloride resin, phenol resin, polyethylene resin, polypropylene resin, polyurthane resin, silicone resin, or mixtures made by arbitrarily mixing those resins. The binder resin should preferably have softening temperature in the range of about 80-160 degrees C., and have a glass transition point in the range of about 50-75 degrees C.

(Coloring Agent)

Materials usable for the coloring agent include publicly known materials such as carbon black, aniline black, activated carbon, magnetite, benzine yellow, permanent yellow, naphthol yellow, copper phthalocyanine blue, first sky blue, ultra marine blue, rose bengal and rake red. It is preferred that the added amount of the coloring agent should generally be 2-20 weight parts with respect to 100 weight parts of binder resin.

(Charge Control Agent)

Materials conventionally known as charge control agents can be used as a charge control agent. Concretely, usable as a charge control agent for the toner charged to positive polarity include, for example, nigrosine-based dye, quarternary-ammonium-salt-based compounds, triphenylmethane-based compounds, the imidazole-based compounds, and polyamine resin. Materials usable for the charge control agent for the toner charged to negative polarity include azo-based dye containing metal such as Cr, Co, Al and Fe, salicylic-acid metallic compounds, alkyl salicylic-acid metallic compounds, and calyx arene compounds. The charge control agent should preferably be used at a rate of 0.1 to 10 weight parts to 100 weight parts of binder resin.

(Release Agent)

Publicly known release agents which have conventionally been used can be used as a release agent. Examples of the materials of the release agent include polyethylene, polypropylene, carnauba wax, sasol wax, and mixtures made by appropriately mixing these materials. The release agent should preferably be used at a rate of 0.1 to 10 weight parts with respect to 100 weight parts of binder resin.

(The Other Additives)

In addition, superplasticizers which promote fluidization of the developer may be added. Materials usable for the superplasticizer include inorganic particulates such as silica, titanium oxide and aluminum oxide, and resin particulates such as acrylic resin, styrene resin, silicone resin and fluororesin. It is particularly preferred to use materials rendered hydrophobic by silane coupling agents, titanium coupling agents, silicone oil and the like. It is preferred to add the superplasticizer at a rate of 0.1 to 5 weight parts with respect to 100 weight parts of toner. The number average primary particle size of these additives should preferably be 9-100 nm.

(Carrier)

Publicly known carriers which have conventionally and generally been used can be used as a carrier. Either the binder type carrier or the coat type carrier may be used. The carrier particle size, which is not restrictive, is preferably be about 15-100 micrometers.

The binder type carrier is structured by distributing magnetic particulates in the binder resin. Those having particulates or a coating layer charged to positive polarity or negative polarity on the surface can be used. The charging characteristics of the binder type carrier such as polarity can be controlled by the materials of the binder resin and the kinds of the chargeable particulate and the surface coating layer.

Examples of the binder resin used for the binder type carrier include thermoplastics such as vinyl-based resin exemplified by polystyrene-based resin, polyester-based resin, nylon-based resin and polyolefin-based resin, and cured resin such as phenol resin.

Materials usable for the magnetic particulate of the binder type carrier include spinel ferrite such as magnetite and gamma ferric oxid, spinel ferrite containing one or more kinds of metal other than iron (Mn, nickel, Mg, Cu, etc.), magneto plumbite type ferrite such as barium ferrite, and particles made of iron and alloy having an oxidizing zone on the surface. The shape of the carrier may be any one of a grain, a sphere and a needle. In the case of requiring particularly high magnetization, it is preferred to use iron-based ferromagnetic particulate. In consideration of chemical stability, it is preferred to use ferromagnetic particulates made of spinel ferrite including magnetite and gamma ferric oxide as well as magneto plumbite type ferrite such as barium ferrite. By appropriately choosing the kinds and the contents of the ferromagnetic particulate, the magnetic resin carrier having desired magnetization can be obtained. It is appropriate to add 50 to 90 weight percent magnetic particulate in the magnetic resin carrier.

Surface coat materials of the binder type carrier include silicone resin, acrylic resin, epoxy resin and fluororesin. Charge imparting capacity of the carrier can be enhanced by coating the carrier surface with these resins and hardening them to form a coated layer.

Adhesion of the chargeable particulate or conductive particle to the surface of the binder type carrier is achieved by, for example, homogeneously mixing magnetic resin carrier and the particulates, attaching these particulates to the surface of the magnetic resin carrier, and giving mechanical and thermal impulsive force so as to implant the particulates into the magnetic resin carrier. In this case, the particulates are not completely buried in the magnetic resin carrier, but they are fixed so that a part thereof may project from the surface of the magnetic resin carrier. Organic and inorganic insulating materials are used for chargeable particulates. Concretely, organic insulating materials include organic insulating particulates such as polystyrene, styrene-based copolymer, acrylic resin, various acrylic copolymers, nylon, polyethylene, polypropylene, fluororesin, and cross-links thereof.

Charge imparting capacity and charged polarity can be adjusted by the materials of the chargeable particulates, polymerization catalysts, surface treatment and the like. Inorganic insulating materials include inorganic particulates charged to negative polarity such as silica and titanium dioxide, and inorganic particulates charged to positive polarity such as titanic acid strontium and alumina.

The coat type carrier is a carrier having a carrier core particle made of a magnetic substance covered with resin. Chargeable particulates charged to positive polarity or negative polarity can adhere to the carrier surface like the binder type carrier. The charging characteristics of the coat type carrier such as polarity can be adjusted by selection of the kinds of surface coating layers and chargeable particulates. As the coating resin, resin similar to the binder resin for the binder type carrier can be used.

The mixing ratio of the toner and the carrier should just be adjusted so that a desired toner charge amount may be obtained, and the toner ratio should preferably be 3 to 50 weight percent, more preferably be 6 to 30 weight percent, with respect to the total amount of the toner and the carrier.

[Experiment]

Various experiments as described below were conducted using an image forming apparatus having the developing device of FIG. 1 to examine recovery performance of development residual toner from the developing roller and the like.

(Toner A)

The manufacturing method of the toner used for the experiment is as follows. To 100 weight parts of a toner base material with a volume average particle diameter of about 6.5 micrometers created by wet granulation, a plurality of additive, 0.2 weight parts of first hydrophobic silica, 0.5 weight parts of second hydrophobic silica, and 0.5 weight-parts of hydrophobic titanium oxide, were added. Next, the toner base material with the additives added thereto was stirred by using a Henschel mixer manufactured by Mitsui Mining Co., Ltd., to attach the additives to the surface of the toner base material, so that the toner with negative chargeability was obtained. Rotational velocity of the mixer was 40 m/second, and mixing time was 3 minutes. The first hydrophobic silica was obtained by applying surface treatment to silica having a number average primary particle size of 16 nm (#130: made by Japan Aerosil Co.) with use of a hydrophobic agent or hexamethyldisilazane (HMDS). The second hydrophobic silica was obtained by applying surface treatment to silica having a solid average primary particle size of 20 nm (#90: made by Japan Aerosil Co.) with use of HMDS. The hydrophobic titanium oxide was obtained by applying surface treatment to anatase-type titanium oxide having a number average primary particle size of 30 nm with use, of a hydrophobic agent or iso butyltrimethoxysilane under water-based wet environment.

(Carrier)

The carrier used for the experiment is bizhub C350 carrier (with an average particle diameter of about 33 micrometers) made by Konica Minolta Business Technologies, Inc. This carrier is a coat type carrier having a carrier core particle constituted from a magnetic substance coated with acrylic resin.

(Charged Particle)

As a charged particle for use in the experiment, titanic acid strontium with a number average particle size of 350 nm was added. The added amount of the charged particle was 2 weight parts with respect to 100 weight parts of the toner base material contained in toner A. Next, the toner A with the charged particle added thereto was stirred using a Henschel mixer manufactured by Mitsui Mining Co., Ltd., to attach the charged particle to the surface of the toner. Rotational velocity of the mixer was 40 m/second, and mixing time was 3 minutes.

(Developer)

The developer for use in the experiment was formed by mixing the toner A, the carrier, the charged particle and other additives (e.g., release agent and superplasticizer) and the toner ratio in the developer was adjusted to 8%. The toner ratio is a rate of the total weight of the toner and additives including the charged particle to the weight of the entire developer.

EXPERIMENTAL EXAMPLE 1

The supply/recovery gap which is a closest section between the developing roller and the conveying roller was set to 0.3 mm. A developing bias with a DC voltage of −300 v was applied to the developing roller. The experiment was conducted with a so-called contact development structure in which the developing roller comes into contact with the photoconductor via a toner layer.

Under such conditions, rectangular-wave oscillating biases shown in FIGS. 10(*f*) and (*g*) were applied to the conveying roller to form oscillating electric fields as shown in FIGS. 11(*f*) and (*g*) in the supply/recovery region, in order to evaluate the recovery performance of development residual toner from the developing roller, and an auxiliary carrier charging function by the charged particle. The oscillating voltage was fixed to a frequency of 2 kHz, an amplitude of 1000 v, and an amplitude median value of −700 v while the duty ratio (expressed as "duty" in each table and drawing below) was varied from 10% to 90% in increments of 10%.

Figure 17A:
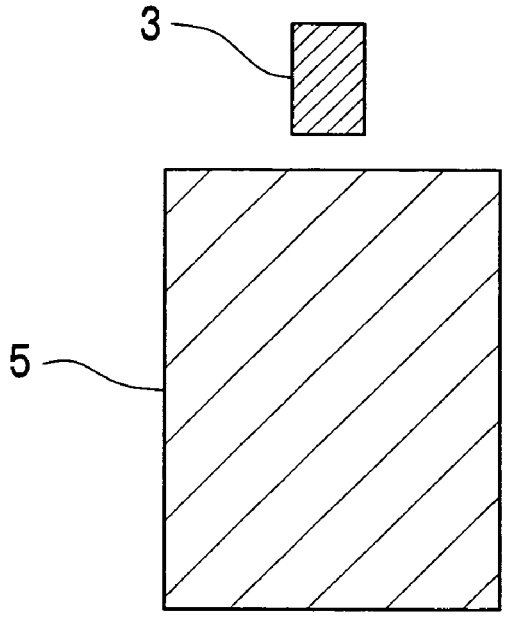
FIG. 17A is a view for explaining a memory image.
Figure 17B:
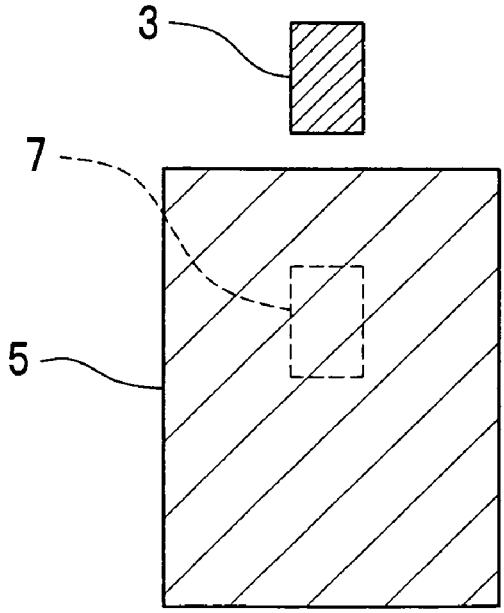
FIG. 17B is a view for explaining the memory image.

Herein, the recovery performance of development residual toner was evaluated by presence of afterimage or memory image as shown in FIG. 17B, and a value obtained by dividing a difference of toner charge amounts on the developing roller during continuous printing in a full white state with an image area ratio of 0% and during black solid image continuous printing with an image area ratio of 100% by the toner charge amount during the full white continuous printing (hereinafter referred to as "solid charge difference ratio"). The auxiliary carrier charging function by the charged particle was evaluated by a value obtained by dividing the charge amount of the toner on the developing roller after the endurance printing, which was performed on 50,000 sheets (or 50k sheets) using an image chart with an image area ratio of 5% under each condition, by the toner charge amount in the initial state before the start of the endurance printing (hereinafter referred to as "endurance charge difference ratio"). These evaluations were rated on four levels, "double circle: excellent", "circle: good", "delta: not so bad but unacceptable", and "christcross: unacceptable." The experimental results and evaluations are shown in Table 1 below. The criterion for four-level ranking in each evaluation is also shown with Table 1. It is to be noted that in Table 1 (and in other tables mentioned later), the solid charge difference ratio is referred to as "charge amount difference/white charge amount delta Q/Qw", and the endurance charge difference ratio is referred to as "charge amount difference/initial charge amount delta Q/Qi".

TABLE 1

Developing bias is fixed to −300 V.
The gap of supply/recovery section is fixed to 0.3 mm.

| Applied bias to developer conveying roller | | | | Electric field state in supply/recovery section | | | | | White and solid charge amount difference (on developing roller) | | | Charge amount difference before and after 50K endurance printing | | |
|---|---|---|---|---|---|---|---|---|---|---|---|---|---|---|
| Frequency (Hz) | Amplitude (V) | Median value (V) | duty (%) | Supply direction (V/m) | Recovery direction (V/m) | Recovery duty (%) | Average supply electric field (V/m) | Memory image Rank | Charge amount difference ΔQ/M | Charge amount difference/ white charge amount ΔQ/Qw | Rank | Charge amount difference ΔQ/M | Charge amount difference/ initial charge amount ΔQ/Qi | Rank |
| 2000 | 1000 | −700 | 10 | 3.0E+06 | 3.3E+05 | 90 | 0.0E+00 | x | 8.4 | 0.20 | x | 5.7 | 0.14 | ○ |
| 2000 | 1000 | −700 | 20 | 3.0E+06 | 3.3E+05 | 80 | 3.3E+05 | ○ | 2.3 | 0.05 | ◎ | 4.3 | 0.10 | ◎ |
| 2000 | 1000 | −700 | 30 | 3.0E+06 | 3.3E+05 | 70 | 6.7E+05 | ○ | 1.8 | 0.04 | ◎ | 2.4 | 0.06 | ◎ |
| 2000 | 1000 | −700 | 40 | 3.0E+06 | 3.3E+05 | 60 | 1.0E+06 | ○ | 3.5 | 0.08 | ○ | 3.1 | 0.07 | ◎ |
| 2000 | 1000 | −700 | 50 | 3.0E+06 | 3.3E+05 | 50 | 1.3E+06 | x | 6.4 | 0.15 | Δ | 2.3 | 0.05 | ◎ |
| 2000 | 1000 | −700 | 60 | 3.0E+06 | 3.3E+05 | 40 | 1.7E+06 | x | 10.2 | 0.24 | x | 1.7 | 0.04 | ◎ |
| 2000 | 1000 | −700 | 70 | 3.0E+06 | 3.3E+05 | 30 | 2.0E+06 | x | 8.8 | 0.21 | x | 4.5 | 0.11 | ◎ |
| 2000 | 1000 | −700 | 80 | 3.0E+06 | 3.3E+05 | 20 | 2.3E+06 | x | 9.3 | 0.22 | x | 3.5 | 0.08 | ◎ |
| 2000 | 1000 | −700 | 90 | 3.0E+06 | 3.3E+05 | 10 | 2.7E+06 | x | 11.0 | 0.26 | x | 3.8 | 0.09 | ◎ |

| White vs solid charge amount determination | | Charge amount fluctuation determination | |
|---|---|---|---|
| Rank | ΔQ/Qw | Rank | ΔQ/Qi |
| ◎ (Excellent) | ~0.06 | ◎ (Excellent) | ~0.12 |
| ○ (Good) | 0.06~0.12 | ○ (Good) | 0.12~0.24 |
| Δ (Unacceptable) | 0.12~0.18 | Δ (Acceptable) | 0.24~0.36 |
| x (Unacceptable) | 0.18 or more | x (Unacceptable) | 0.36 or more |

As shown in Table 1, the result of the experiment indicated that memory images were not generated when the time ratio (recovery side duty ratio) for activating the electric field in the direction of collecting development residual toner from the developing roller is in the range of 60%-80% and that the recovery performance in this range was considerably higher than that in other ranges. It is generally anticipated that the stronger the average recovery electric field acting on the development residual toner on the developing roller becomes, i.e., the weaker the average supply electric field in Table 1 becomes, the more the recovery performance is enhanced. However, even when the average supply electric field varied to some extent, significant enhancement in the recovery performance was not observed if the recovery side duty ratio was in the range of 50% or less, whereas when the recovery side duty ratio was increased up to 90%, it was found out that the recovery performance deteriorated compared with the case where the recovery side duty ratio was 80%. This phenomenon agrees with the presumption that "there is an optimal range for the time ratio for functioning of the recovery direction electric field and the supply direction electric field and that sufficient pumping is not performed if the time ratio is too small or too large", as explained in the aforementioned pumping action.

In the evaluation of durable printing performed under each condition shown in Table 1, a difference between the initial charge amount and the charge amount after endurance printing as well as a endurance charge difference ratio were small in each case, and the resultant values were fallen within a satisfactory range.

EXPERIMENTAL EXAMPLE 2

In an experimental example 2, a developing bias formed by superimposing a rectangular-wave oscillating bias having a frequency of 2 kHz and an amplitude of 1600 v on a DC voltage of −300 v was applied to the developing roller, and a so-called non-contact development structure, in which a development gap in the closest section between the photoconductor and the developing roller was set to 0.15 mm, was formed to conduct an experiment for evaluation similar to that conducted in the experimental example 1. The supply/recovery gap was set to 0.3 mm as in the experimental example 1. While an oscillating bias was used as a bias applied to the developing roller, the bias applied to the conveying roller was adjusted so that the electric field in the supply/recovery region between the developing roller and the conveying roller was identical to that in the experimental example 1. That is, waveform voltages shown in FIGS. 10(*b*) and (*c*) were applied to the conveying roller so as to activate the oscillating electric fields as shown in FIGS. 11(*b*) and (*c*) in the supply/recovery region. In FIG. 10(*c*), the conveying roller bias is synchronized with the developing roller bias, and its amplitude is set to a larger value. If the duty ratios of the developing bias applied to the developing roller and the bias applied to the conveying roller are different, an excessive potential difference is generated between both the biases, resulting in leak in the supply/recovery region. Accordingly, the experiment was conducted with the duty ratio of the developing bias being varied according to the duty ratio of the oscillating electric field activated in the supply/recovery region. A phenomenon in which the texture of images show considerable deterioration was observed when an duty ratio of over 50% was imparted to the developing roller. Accordingly, the duty ratio applied to the developing roller was set in the range up to 50%, and the recovery side duty ratio of the electric field in the supply/recovery region was set to 10 to 50% by applying a bias to the conveying roller so as to achieve the state shown in FIG. 10(*b*), while the recovery side duty ratio was set to 50 to 90% by applying a bias to the conveying roller so as to achieve the state shown in FIG. 10(*c*). The experiment was conducted under such conditions and the result and the evaluation thereof were shown in Table 2 below. The criterion for four-level ranking in each evaluation is also shown with Table 2 as with Table 1.

TABLE 2

Developing bias is Vpp1600, Vdc-300, 2 kHz, while development gap is fixed to 0.15 mm. The gap of supply/recovery section is fixed to 0.3 mm.

| Negative side duty to developing roller | Applied bias to developer conveying roller: Frequency (Hz) | Amplitude (V) | Median value (V) | Negative side duty (%) | Electric field state in supply/recovery section: Supply direction (V/m) | Recovery direction (V/m) | Recovery duty (%) | Average supply electric field (V/m) |
|---|---|---|---|---|---|---|---|---|
| 10 | 2000 | 2600 | −700 | 10 | 3.0E+06 | 3.3E+05 | 90 | 0.0E+00 |
| 20 | 2000 | 2600 | −700 | 20 | 3.0E+06 | 3.3E+05 | 80 | 3.3E+05 |
| 30 | 2000 | 2600 | −700 | 30 | 3.0E+06 | 3.3E+05 | 70 | 6.7E+05 |
| 40 | 2000 | 2600 | −700 | 40 | 3.0E+06 | 3.3E+05 | 60 | 1.0E+06 |
| 50 | 2000 | 2600 | −700 | 50 | 3.0E+06 | 3.3E+05 | 50 | 1.3E+06 |
| 50 | 2000 | 600 | −700 | 50 | 3.0E+06 | 3.3E+05 | 50 | 1.3E+06 |
| 40 | 2000 | 600 | −700 | 40 | 3.0E+06 | 3.3E+05 | 40 | 1.7E+06 |
| 30 | 2000 | 600 | −700 | 30 | 3.0E+06 | 3.3E+05 | 30 | 2.0E+06 |
| 20 | 2000 | 600 | −700 | 20 | 3.0E+06 | 3.3E+05 | 20 | 2.3E+06 |
| 10 | 2000 | 600 | −700 | 10 | 3.0E+06 | 3.3E+05 | 10 | 2.7E+06 |

| Negative side duty to developing roller | Memory image Rank | White and solid charge amount difference (on developing roller): Charge amount difference ΔQ/M | Charge amount difference/white charge amount ΔQ/Qw | Rank | Charge amount difference before and after 50K endurance printing: Charge amount difference ΔQ/M | Charge amount difference/initial charge amount ΔQ/Qi | Rank |
|---|---|---|---|---|---|---|---|
| 10 | x | 8.3 | 0.20 | x | 2.8 | 0.07 | ◎ |
| 20 | ○ | 1.4 | 0.03 | ◎ | 4.3 | 0.10 | ◎ |
| 30 | ○ | 1.9 | 0.05 | ◎ | 4.1 | 0.10 | ◎ |
| 40 | ○ | 2.3 | 0.05 | ○ | 2.3 | 0.05 | ◎ |
| 50 | x | 6.9 | 0.16 | Δ | 3.1 | 0.07 | ◎ |
| 50 | x | 6.5 | 0.15 | Δ | 4.0 | 0.10 | ◎ |
| 40 | x | 7.8 | 0.19 | x | 1.8 | 0.04 | ◎ |
| 30 | x | 8.8 | 0.21 | x | 3.8 | 0.09 | ◎ |
| 20 | x | 9.7 | 0.23 | x | 2.3 | 0.05 | ◎ |
| 10 | x | 9.4 | 0.22 | x | 5.2 | 0.12 | ○ |

| White vs solid charge amount determination: Rank | ΔQ/Qw | Charge amount fluctuation determination: Rank | ΔQ/Qi |
|---|---|---|---|
| ◎ (Excellent) | ~0.06 | ◎ (Excellent) | ~0.12 |
| ○ (Good) | 0.06~0.12 | ○ (Good) | 0.12~0.24 |
| Δ (Unacceptable) | 0.12~0.18 | Δ (Acceptable) | 0.24~0.36 |
| x (Unacceptable) | 0.18 or more | x (Unacceptable) | 0.36 or more |

As shown in Table 2, it was found out that even when an oscillating voltage was applied to the developing roller, the electric field state which effectually acts on the supply/recovery region was unchanged and so the same result as that in the experimental example 1 could be obtained. This indicated that even in the structure of applying a DC voltage to the developing roller for non-contact development, or in the structure in which a developing bias formed by superimposing an oscillating bias on a DC voltage is applied to the developing roller for contact development, the recovery performance is increased by achieving the electric field state in the supply/recovery region in conformity to the concept of the present invention.

EXPERIMENTAL EXAMPLE 3

Figure 15:
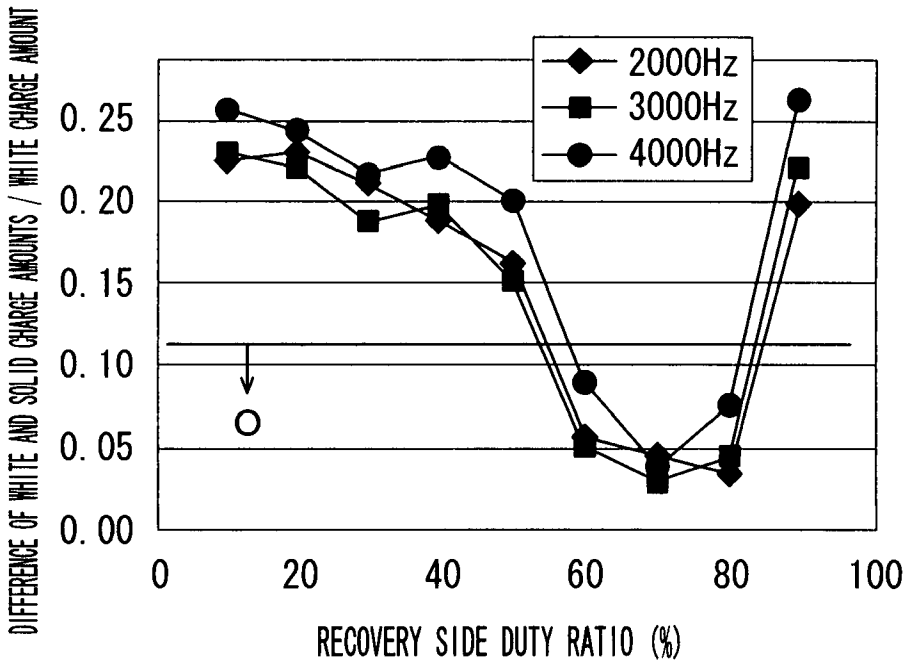
FIG. 15 is a table and graph view showing the experimental result of an experimental example 3.

An experiment was conducted to examine whether the same function as in the experimental example 2 can be acquired in the case where a device similar to that in the experimental example 2 is used and the frequency of oscillating biases applied to the developing roller and the conveying roller is 3 kHz and 4 kHz. As a result of the experiment, solid charge difference ratios are shown in the table and graph view in FIG. 15 together with the result of the experimental example 2. As is clear from FIG. 15, the recovery side duty ratio efficient for pumping of the toner on the developing roller regardless of the frequency is 60% to 80%.

EXPERIMENTAL EXAMPLE 4

Figure 16:
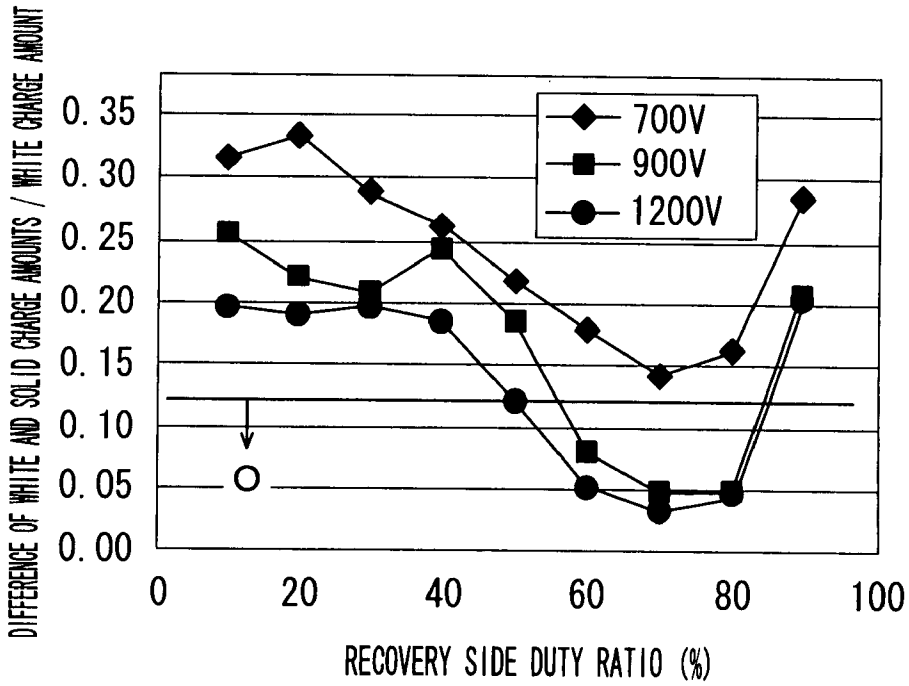
FIG. 16 is a table and graph view showing the experimental result of an experimental example 4.

An experiment was conducted with use of a device identical to that in the experimental example 1 and with the amplitude of an oscillating bias applied to the conveying roller being varied to three levels, 600 v, 900 v and 1200 v. As a result of the experiment, solid charge difference ratios are shown in the table and graph view in FIG. 16. As is clear from FIG. 16, the recovery performance can particularly be enhanced when the amplitude of the oscillating bias applied to the conveying roller is set to 900 v or more. Since the supply/recovery gap is set to 0.3 mm in the experimental example 1, the electric field involving the pumping action of the toner on the developing roller corresponds to $2\times10^6$ V/m, $3\times10^6$ V/m, and $4\times10^6$ V/m, respectively, in this experimental example. Therefore, it was found out that in order to satisfy the function of the present invention, that is, to enhance the recovery performance by producing the pumping action, a field strength amplitude value of $3\times10^6$ V/m or more should be imparted.

EXPERIMENTAL EXAMPLE 5

An experiment was conducted under the conditions based on the experimental example 1 with the amplitude median value of an oscillating bias applied to the conveying roller being varied. Here, the median value of −700 v is identical to that in the experimental example 1. In this experimental example, in addition to the presence of memory images, the toner transportation amount on the developing roller was also evaluated. The result thereof is shown in Table 3 below together with the ranking criterion for evaluation of the solid charge difference ratio.

TABLE 3

Developing bias is fixed to −300 V.
The gap of supply/recovery section is fixed to 0.3 mm.

| Applied bias to developer conveying roller | | | | Electric field state in supply/recovery section | | | | Transportation amount on developing roller | | White and solid charge amount difference (on developing roller) Charge amount | | |
|---|---|---|---|---|---|---|---|---|---|---|---|---|
| Frequency (Hz) | Amplitude (V) | Median value (V) | Duty (%) | Supply direction (V/m) | Recovery direction (V/m) | Recovery duty (%) | Average supply electric field (V/m) | Transportation amount on developing roller ($g/m^2$) | Memory image Rank | Charge amount difference ΔQ/M | Charge amount difference/white charge amount ΔQ/Qw | Rank |
| 2000 | 1000 | −400 | 10 | 2.0E+06 | 1.3E+05 | 90 | −1.0E+06 | 0.1 | Evaluation unavailable | Evaluation unavailable | Evaluation unavailable | Evaluation unavailable |
| 2000 | 1000 | −400 | 20 | 2.0E+06 | 1.3E+05 | 80 | −6.7E+05 | 0.5 | Evaluation unavailable | Evaluation unavailable | Evaluation unavailable | Evaluation unavailable |
| 2000 | 1000 | −400 | 30 | 2.0E+06 | 1.3E+05 | 70 | −3.3E+05 | 1.8 | Evaluation unavailable | Evaluation unavailable | Evaluation unavailable | Evaluation unavailable |
| 2000 | 1000 | −400 | 40 | 2.0E+06 | 1.3E+05 | 60 | 0.0E+00 | 2.6 | Evaluation unavailable | Evaluation unavailable | Evaluation unavailable | Evaluation unavailable |
| 2000 | 1000 | −400 | 50 | 2.0E+06 | 1.3E+05 | 50 | 3.3E+05 | 4.6 | x | 8.6 | 0.20 | x |
| 2000 | 1000 | −400 | 60 | 2.0E+06 | 1.3E+05 | 40 | 6.7E+05 | 5.3 | x | 10.5 | 0.25 | x |
| 2000 | 1000 | −400 | 70 | 2.0E+06 | 1.3E+05 | 30 | 1.0E+06 | 5.5 | x | 9.8 | 0.23 | x |
| 2000 | 1000 | −400 | 80 | 2.0E+06 | 1.3E+05 | 20 | 1.3E+06 | 5.8 | x | 10.1 | 0.24 | x |
| 2000 | 1000 | −400 | 90 | 2.0E+06 | 1.3E+05 | 10 | 1.7E+06 | 6.0 | x | 12.2 | 0.29 | x |
| 2000 | 1000 | −700 | 10 | 3.0E+06 | 3.3E+05 | 90 | 0.0E+00 | 3.2 | x | 8.4 | 0.20 | x |
| 2000 | 1000 | −700 | 20 | 3.0E+06 | 3.3E+05 | 80 | 3.3E+05 | 4.9 | ○ | 2.3 | 0.05 | ◎ |
| 2000 | 1000 | −700 | 30 | 3.0E+06 | 3.3E+05 | 70 | 6.7E+05 | 5.7 | ○ | 1.8 | 0.04 | ◎ |
| 2000 | 1000 | −700 | 40 | 3.0E+06 | 3.3E+05 | 60 | 1.0E+06 | 6.1 | ○ | 3.5 | 0.08 | ○ |
| 2000 | 1000 | −700 | 50 | 3.0E+06 | 3.3E+05 | 50 | 1.3E+06 | 6.2 | x | 6.4 | 0.15 | Δ |
| 2000 | 1000 | −700 | 60 | 3.0E+06 | 3.3E+05 | 40 | 1.7E+06 | 6.5 | x | 10.2 | 0.24 | x |
| 2000 | 1000 | −700 | 70 | 3.0E+06 | 3.3E+05 | 30 | 2.0E+06 | 7.0 | x | 8.8 | 0.21 | x |
| 2000 | 1000 | −700 | 80 | 3.0E+06 | 3.3E+05 | 20 | 2.3E+06 | 7.2 | x | 9.3 | 0.22 | x |
| 2000 | 1000 | −700 | 90 | 3.0E+06 | 3.3E+05 | 10 | 2.7E+06 | 7.7 | x | 11.0 | 0.26 | x |
| 2000 | 1000 | −1000 | 10 | 4.0E+06 | −6.7E+05 | 90 | 1.0E+06 | 5.7 | x | 10.2 | 0.24 | x |
| 2000 | 1000 | −1000 | 20 | 4.0E+06 | −6.7E+05 | 80 | 1.3E+06 | 6.0 | x | 11.0 | 0.26 | x |
| 2000 | 1000 | −1000 | 30 | 4.0E+06 | −6.7E+05 | 70 | 1.7E+06 | 5.9 | x | 13.0 | 0.31 | x |

TABLE 3-continued

Developing bias is fixed to −300 V.
The gap of supply/recovery section is fixed to 0.3 mm.

| | | | | | | | | | | | | |
|---|---|---|---|---|---|---|---|---|---|---|---|---|
| 2000 | 1000 | −1000 | 40 | 4.0E+06 | −6.7E+05 | 60 | 2.0E+06 | 6.4 | x | 10.5 | 0.25 | x |
| 2000 | 1000 | −1000 | 50 | 4.0E+06 | −6.7E+05 | 50 | 2.3E+06 | 6.8 | x | 9.8 | 0.23 | x |
| 2000 | 1000 | −1000 | 60 | 4.0E+06 | −6.7E+05 | 40 | 2.7E+06 | 6.3 | x | 11.5 | 0.27 | x |
| 2000 | 1000 | −1000 | 70 | 4.0E+06 | −6.7E+05 | 30 | 3.0E+06 | 7.2 | x | 12.0 | 0.29 | x |
| 2000 | 1000 | −1000 | 80 | 4.0E+06 | −6.7E+05 | 20 | 3.3E+06 | 7.2 | x | 10.8 | 0.26 | x |
| 2000 | 1000 | −1000 | 90 | 4.0E+06 | −6.7E+05 | 10 | 3.7E+06 | 7.9 | x | 11.0 | 0.26 | x |

White vs solid charge amount determination

| Rank | ΔQ/Qw |
|---|---|
| ◎ (Excellent) | ~0.06 |
| ○ (Good) | 0.06~0.12 |
| Δ (Unacceptable) | 0.12~0.18 |
| x (Unacceptable) | 0.18 or more |

The result of the experiment shown in Table 3 indicates the followings. In the condition in which the recovery direction electric field from the developing roller to the conveying roller was strengthened with the median value set to −400 v, the time average field strength in the supply/recovery region went negative, i.e., the poor toner supply state was brought about in the range of a large recovery side duty ratio which implements easy activation of the pumping action, which hinders supply of an appropriate amount of toner to the developing roller. As a result, it became impossible to obtain desired image density, and therefore evaluation of memory images as well as evaluation of the solid charge difference ratio were unattainable. Even under such conditions, if the recovery side duty ratio was decreased to gain positive time average field strength, i.e., in the case of the electric field of the toner supply direction, then memory images were generated due to the absence of the pumping action though sufficient toner supply to the developing roller was ensured.

In the condition in which the toner supply direction electric field from the developing roller to the conveying roller was strengthened with the median value of −1000 v, a sufficient amount of toner supply to the developing roller can be ensured, although the recovery direction electric field went negative, i.e., the state without the recovery direction electric field was brought about, so that the pumping action could not be attained.

In short, in order to maintain good charging performance while preventing generating of the memory image by high recovery performance, it is important to form, in the supply/recovery region, an oscill-*ating electric field having both a function to supply toner to the developing roller and a function to collect the toner from the developing roller, while the time average field strength is biased to the side where the toner is supplied from the first conveyance roller to developing roller, and to set the time ratio for carrying out the function to collect the toner from the developing roller to 60% to 80%.

EXPERIMENTAL EXAMPLE 6

An experiment was conducted by using a device similar to that in the experimental example 2 and applying biases as shown in FIGS. 10(*c*) and (*d*) to examine the recovery performance and a leak phenomenon in the supply/recovery region. Since the application of a waveform bias shown in FIG. 10(*d*) is based on the idea of securing the recovery performance by strengthening the recovery field strength, the recovery field strength was varied by changing the amplitude value of the oscillating bias applied to the conveying roller while the duty ratio was fixed. The result thereof is shown in Table 4 below together with the ranking criterion for evaluation of the solid charge difference ratio.

TABLE 4

Developing bias is Vpp1600, Vdc-300, 2 kHz, while development gap is fixed to 0.15 mm.
The gap of supply/recovery section is fixed to 0.3 mm.

| | Negative side duty to developing roller | Applied bias to developer conveying roller: Frequency (Hz) | Amplitude (V) | Median value (V) | Negative side duty | Electric field state in supply/recovery section: Supply direction (V/m) | Recovery direction (V/m) | Recovery duty (%) | Average supply electric field (V/m) | Memory image Rank | White and solid charge amount difference (on developing roller): Charge amount difference ΔQ/M | Charge amount difference/white charge amount ΔQ/Qw | Rank | Leak occurrence |
|---|---|---|---|---|---|---|---|---|---|---|---|---|---|---|
| Waveform of FIG. 10(c) | 10 | 2000 | 2600 | −700 | 10 | 3.0E+06 | 3.3E+05 | 90 | 0.0E+00 | x | 8.3 | 0.20 | x | None |
| | 20 | 2000 | 2600 | −700 | 20 | 3.0E+06 | 3.3E+05 | 80 | 3.3E+05 | ○ | 1.4 | 0.03 | ◎ | None |
| | 30 | 2000 | 2600 | −700 | 30 | 3.0E+06 | 3.3E+05 | 70 | 6.7E+05 | ○ | 1.9 | 0.05 | ◎ | None |
| | 40 | 2000 | 2600 | −700 | 40 | 3.0E+06 | 3.3E+05 | 60 | 1.0E+06 | ○ | 2.3 | 0.05 | ○ | None |
| | 50 | 2000 | 2600 | −700 | 50 | 3.0E+06 | 3.3E+05 | 50 | 1.3E+06 | x | 6.9 | 0.16 | Δ | None |
| Wave- | 30 | 2000 | 250 | −400 | 70 | 3.4E+06 | 2.8E+06 | 30 | 1.6E+06 | x | 7.5 | 0.18 | x | None |

TABLE 4-continued

| Developing bias is Vpp1600, Vdc-300, 2 kHz, while development gap is fixed to 0.15 mm. The gap of supply/recovery section is fixed to 0.3 mm. | | | | | | | | | | | | | | |
|---|---|---|---|---|---|---|---|---|---|---|---|---|---|---|
| form | 30 | 2000 | 500 | −400 | 70 | 3.8E+06 | 3.2E+06 | 30 | 1.7E+06 | x | 8.0 | 0.19 | x | None |
| of | 30 | 2000 | 750 | −400 | 70 | 4.3E+06 | 3.6E+06 | 30 | 1.9E+06 | x | 3.9 | 0.09 | ○ | x |
| FIG. | 30 | 2000 | 1000 | −400 | 70 | 4.7E+06 | 4.0E+06 | 30 | 2.1E+06 | ○ | 2.2 | 0.05 | ◎ | x |
| 10(d) | 30 | 2000 | 1250 | −400 | 70 | 5.1E+06 | 4.4E+06 | 30 | 2.2E+06 | ○ | 1.5 | 0.04 | ◎ | x |

White vs solid charge amount determination

| Rank | ΔQ/Qi |
|---|---|
| ◎ (Excellent) | ~0.06 |
| ○ (Good) | 0.06~0.12 |
| Δ (Unacceptable) | 0.12~0.18 |
| x (Unacceptable) | 0.18 or more |

Although generating of the memory image was prevented by strengthening the recovery direction electric field even with the waveform in FIG. 10(*d*), leak occurred in the supply/recovery region because of excessively high field strength as shown in Table 4. However, it has been confirmed that the waveform of FIG. 10(*c*) in accordance with the concept of the present invention can provide high recovery performance by utilizing the pumping action even in the condition of low electric field strength which does not cause leak in the supply/recovery region.

EXPERIMENTAL EXAMPLE 7

In order to maintain the charging performance of the developer for a long period of time, the charged particles attached to the outside of the toner need to be detached from the toner in the supply/recovery region and then be taken into the developer on the conveying roller to be attached to the carrier surface. An experiment was conducted with use of the device of experimental example 2 to examine whether or not both the reduction of a toner charge amount difference before and after endurance printing by this operation and the pumping action can be achieved. Since the parameter concerning detachment of the charged particle from the toner was a supply electric field for supplying the toner to the developing roller from the conveying roller, an applied bias to the conveying roller was adjusted so as to vary the field strength in the supply direction while the field strength in the recovery direction was fixed. Conditions used in the experiment, the presence of memory images, and the endurance charge difference ratio after 50,000-sheet endurance printing are shown in table 5 below. The criterion for each evaluation ranking of the memory image and the solid charge difference ratio is identical to that of each experimental example described above.

TABLE 5

| Developing bias is Vpp1600, Vdc-300, 2 kHz, while development gap is fixed to 0.15 mm. The gap of supply/recovery section is fixed to 0.3 mm. | | | | | | | | | |
|---|---|---|---|---|---|---|---|---|---|
| | | Applied bias to developer conveying roller | | | | Electric field state in supply/recovery section | | | |
| | Negative side duty to developing roller | Freq. (Hz) | Amplitude (V) | Median value (V) | Negative side duty (%) | Supply direction (V/m) | Recovery direction (V/m) | Recovery duty (%) | Average supply electric field (V/m) |
| Wave- | 10 | 2000 | 2300 | −550 | 10 | 2.0E+06 | 3.3E+05 | 90 | −1.0E+05 |
| form | 20 | 2000 | 2300 | −550 | 20 | 2.0E+06 | 3.3E+05 | 80 | 1.3E+05 |
| of FIG. | 30 | 2000 | 2300 | −550 | 30 | 2.0E+06 | 3.3E+05 | 70 | 3.7E+05 |
| 10(c) | 40 | 2000 | 2300 | −550 | 40 | 2.0E+06 | 3.3E+05 | 60 | 6.0E+05 |
| | 50 | 2000 | 2300 | −550 | 50 | 2.0E+06 | 3.3E+05 | 50 | 8.3E+05 |
| | 10 | 2000 | 2450 | −625 | 10 | 2.5E+06 | 3.3E+05 | 90 | −5.0E+04 |
| | 20 | 2000 | 2450 | −625 | 20 | 2.5E+06 | 3.3E+05 | 80 | 2.3E+05 |
| | 30 | 2000 | 2450 | −625 | 30 | 2.5E+06 | 3.3E+05 | 70 | 5.2E+05 |
| | 40 | 2000 | 2450 | −625 | 40 | 2.5E+06 | 3.3E+05 | 60 | 8.0E+05 |
| | 50 | 2000 | 2450 | −625 | 50 | 2.5E+06 | 3.3E+05 | 50 | 1.1E+06 |
| | 10 | 2000 | 2600 | −700 | 10 | 3.0E+06 | 3.3E+05 | 90 | 0.0E+00 |
| | 20 | 2000 | 2600 | −700 | 20 | 3.0E+06 | 3.3E+05 | 80 | 3.3E+05 |
| | 30 | 2000 | 2600 | −700 | 30 | 3.0E+06 | 3.3E+05 | 70 | 6.7E+05 |
| | 40 | 2000 | 2600 | −700 | 40 | 3.0E+06 | 3.3E+05 | 60 | 1.0E+06 |
| | 50 | 2000 | 2600 | −700 | 50 | 3.0E+06 | 3.3E+05 | 50 | 1.3E+06 |
| | 10 | 2000 | 2900 | −850 | 10 | 4.0E+06 | 3.3E+05 | 90 | 1.0E+05 |
| | 20 | 2000 | 2900 | −850 | 20 | 4.0E+06 | 3.3E+05 | 80 | 5.3E+05 |

TABLE 5-continued

Developing bias is Vpp1600, Vdc-300, 2 kHz, while development gap is fixed to 0.15 mm. The gap of supply/recovery section is fixed to 0.3 mm.

| | | | | | | | | |
|---|---|---|---|---|---|---|---|---|
| 30 | 2000 | 2900 | −850 | 30 | 4.0E+06 | 3.3E+05 | 70 | 9.7E+05 |
| 40 | 2000 | 2900 | −850 | 40 | 4.0E+06 | 3.3E+05 | 60 | 1.4E+06 |
| 50 | 2000 | 2900 | −850 | 50 | 4.0E+06 | 3.3E+05 | 50 | 1.8E+06 |

| | | | White and solid charge amt. diff. (on developing roller) | | | Charge before and after 50K endurance printing | | | |
|---|---|---|---|---|---|---|---|---|---|
| | Negative side duty to developing roller | Memory image rank | Chg. amt. diff. ΔQ/M | Chg. amt. diff./ white charge amt. ΔQ/Qw | Rank | Chg. amt. diff. ΔQ/M | Chg. amt. diff./ init. chg. amt. ΔQ/Qi | Rank | Leak occurrence |
| Wave-form of FIG. 10(c) | 10 | x | 12.4 | 0.30 | x | 15.3 | 0.36 | x | None |
| | 20 | ○ | 2.6 | 0.06 | ○ | 12.7 | 0.30 | Δ | None |
| | 30 | ○ | 1.4 | 0.03 | ◎ | 15.0 | 0.36 | x | None |
| | 40 | ○ | 2.0 | 0.05 | ◎ | 11.1 | 0.26 | Δ | None |
| | 50 | x | 5.8 | 0.14 | Δ | 13.3 | 0.32 | Δ | None |
| | 10 | x | 8.9 | 0.21 | x | 11.5 | 0.27 | Δ | None |
| | 20 | ○ | 2.2 | 0.05 | ◎ | 7.4 | 0.18 | ○ | None |
| | 30 | ○ | 1.2 | 0.03 | ◎ | 4.3 | 0.10 | ◎ | None |
| | 40 | ○ | 1.9 | 0.05 | ◎ | 3.9 | 0.09 | ◎ | None |
| | 50 | x | 5.2 | 0.12 | Δ | 3.1 | 0.07 | ◎ | None |
| | 10 | x | 8.3 | 0.20 | x | 2.8 | 0.07 | ◎ | None |
| | 20 | ○ | 1.4 | 0.03 | ◎ | 4.3 | 0.10 | ◎ | None |
| | 30 | ○ | 1.9 | 0.05 | ◎ | 4.1 | 0.10 | ◎ | None |
| | 40 | ○ | 2.3 | 0.05 | ○ | 2.3 | 0.05 | ◎ | None |
| | 50 | x | 6.9 | 0.16 | Δ | 3.1 | 0.07 | ◎ | None |
| | 10 | x | 8.9 | 0.21 | x | 4.2 | 0.10 | ◎ | None |
| | 20 | ○ | 3.5 | 0.08 | ○ | 3.6 | 0.09 | ◎ | None |
| | 30 | ○ | 2.3 | 0.05 | ◎ | 2.9 | 0.07 | ◎ | None |
| | 40 | ○ | 4.3 | 0.10 | ○ | 4.4 | 0.10 | ◎ | None |
| | 50 | x | 7.9 | 0.19 | x | 3.0 | 0.07 | ◎ | None |

It was found out that in order to maintain the initial charged state even after endurance printing as shown in Table 5, it was necessary to activate the supply direction electric field of $2.5\times10^6$ V/m or more in the supply/recovery region and that even in that case, the recovery performance could be enhanced by setting the recovery side duty ratio to 60% to 80%. More specifically, it was necessary to strengthen the toner supply direction electric field for supplying the toner to the developing roller while separating the charged particle having a polarity opposite to the toner from the toner. However, if this was implemented, the recoverability of development residual toner was decreased. Consequently, it was found out that in order to achieve both the toner supply performance and the toner recovery performance, which are in a conflicting relation, utilizing the recovery operation by pumping was more effective.

In order to acquire a detaching function of the charged particle from the toner, it is possible to form an oscillating electric field in the supply/recovery region using the waveform biases shown in, for example, FIGS. 10(*b*) and (*d*). The result of an experiment conducted by activating the supply direction electric field of $2.5\times10^6$ V/m or more with these waveforms based on the above finding is shown in table 6 below. The criterion for each evaluation ranking of the solid charge difference ratio and the endurance charge difference ratio is also shown in Table 6.

TABLE 6

Developing bias is Vpp1600, Vdc-300, 2 kHz, while development gap is fixed to 0.15 mm. The gap of supply/recovery section is fixed to 0.3 mm.

| | | Applied bias to developer conveying roller | | | | Electric field state in supply/recovery section | | | |
|---|---|---|---|---|---|---|---|---|---|
| | Negative side duty to developing roller | Freq. (Hz) | Amplitude (V) | Median value (V) | Negative side duty (%) | Supply direction (V/m) | Recovery direction (V/m) | Recovery duty (%) | Average supply electric field (V/m) |
| Wave-form of FIG. 10(b) | 30 | 2000 | 250 | −700 | 30 | 3.6E+06 | 9.2E+05 | 30 | 2.2E+06 |
| | 30 | 2000 | 250 | −700 | 50 | 3.6E+06 | 9.2E+05 | 50 | 1.3E+06 |
| | 30 | 2000 | 750 | −700 | 30 | 2.8E+06 | 8.3E+04 | 30 | 1.9E+06 |
| | 30 | 2000 | 750 | −700 | 50 | 2.8E+06 | 8.3E+04 | 50 | 1.3E+06 |

TABLE 6-continued

| Developing bias is Vpp1600, Vdc-300, 2 kHz, while development gap is fixed to 0.15 mm. The gap of supply/recovery section is fixed to 0.3 mm. | | | | | | | | | |
|---|---|---|---|---|---|---|---|---|---|
| Wave- | 30 | 2000 | 250 | −400 | 70 | 3.4E+06 | 2.8E+06 | 30 | 1.6E+06 |
| form | 30 | 2000 | 250 | −400 | 50 | 3.4E+06 | 2.8E+06 | 50 | 3.3E+05 |
| of | 30 | 2000 | 750 | −400 | 70 | 4.3E+06 | 3.6E+06 | 30 | 1.9E+06 |
| FIG. | 30 | 2000 | 750 | −400 | 50 | 4.3E+06 | 3.6E+06 | 50 | 3.3E+05 |
| 10(d) | | | | | | | | | |

| | | | White and solid charge amount difference (on developing roller) | | | Charge amount difference before and after 50K endurance printing | | | |
|---|---|---|---|---|---|---|---|---|---|
| | Negative side duty to developing roller | Memory image rank | Chg. amt. diff. ΔQ/M | Chg. amt. diff./ white chg. amt. ΔQ/Qw | Rank | Chg. amt. diff. ΔQ/M | Chg. amt. diff./ init. chg. amt. ΔQ/Qi | Rank | Leak occurrence |
| Wave- | 30 | x | 9.8 | 0.23 | x | 4.4 | 0.10 | ◎ | None |
| form | 30 | x | 8.8 | 0.21 | x | 4.3 | 0.10 | ◎ | None |
| of | 30 | x | 10.2 | 0.24 | x | 6.9 | 0.16 | ○ | None |
| FIG. 10(b) | 30 | x | 11.0 | 0.26 | x | 8.2 | 0.20 | ○ | None |
| Wave- | 30 | x | 7.7 | 0.18 | x | 7.7 | 0.18 | ○ | None |
| form | 30 | x | 9.1 | 0.22 | x | 6.5 | 0.15 | ○ | None |
| of | 30 | x | 3.9 | 0.09 | ○ | Not durable due to leak | | | x |
| FIG. 10(d) | 30 | ○ | 1.8 | 0.04 | ◎ | | | | x |

| White vs solid charge amount determination | | Charge amount fluctuation determination | |
|---|---|---|---|
| Rank | ΔQ/Qw | Rank | ΔQ/Qi |
| ◎ (Excellent) | ~0.06 | ◎ (Excellent) | ~0.12 |
| ○ (Good) | 0.06~0.12 | ○ (Good) | 0.12~0.24 |
| Δ (Unacceptable) | 0.12~0.18 | Δ (Acceptable) | 0.24~0.36 |
| x (Unacceptable) | 0.18 or more | x (Unacceptable) | 0.36 or more |

As shown in Table 6, with the waveform of FIG. 10(*b*), the recovery direction electric field was considerably weakened and also the recovery function by pumping could not be obtained, which led to generation of memory images. With the waveform of FIG. 10(*d*), the problem of memory image or leak was caused by the lack of pumping. Therefore, it was confirmed that a relatively small recovery side duty ratio could not solve the problem of memory image in the present invention.

EXPERIMENTAL EXAMPLE 8

An experiment was conducted with the developing device of the image forming apparatus used in the experimental example 1 in which the moving direction of a developing roller peripheral face in the supply/recovery region was made identical to the moving direction of a conveying roller peripheral face. More specifically, the conveying roller was structured to rotate in a direction opposite to the direction shown in FIG. 1 (clockwise direction), while the regulating board was structured to be placed not in the upper side but in the lower side of the conveying roller. Hereafter, the moving direction shared by the peripheral faces of the respective rollers in the supply/recovery region is called "With", while the direction of rotation in which the moving direction of the peripheral faces of the respective rollers in the supply/recovery region are opposite as shown in FIG. 1 is called "Counter".

In this experimental example, endurance printing of 50,000 sheets was performed using an image chart having an image area ratio of 5% in order to evaluate the presence of memory images, the solid charge difference ratio and the endurance charge difference ratio. The result thereof is shown in Table 7 below. The criterion for each evaluation ranking of the solid charge difference ratio and the endurance charge difference ratio is also shown in Table 7.

TABLE 7

| Developing bias is fixed to −300 V. The gap of supply/recovery section is fixed to 0.3 mm. | | | | | | | | |
|---|---|---|---|---|---|---|---|---|
| Moving direction of | Applied basis to developer conveying roller | | | | Electric field state in supply/recovery section | | | |
| development and conveying rollers | Frequency (Hz) | Amplitude (V) | Median value (V) | duty (%) | Supply direction (V/m) | Recovery direction (V/m) | Recovery duty (%) | Average supply electric field (V/m) |
| Counter | 2000 | 1000 | −700 | 10 | 3.0E+06 | 3.3E+05 | 90 | 0.0E+00 |
| Counter | 2000 | 1000 | −700 | 20 | 3.0E+06 | 3.3E+05 | 80 | 3.3E+05 |

TABLE 7-continued

| Developing bias is fixed to −300 V. The gap of supply/recovery section is fixed to 0.3 mm. | | | | | | | | |
|---|---|---|---|---|---|---|---|---|
| Counter | 2000 | 1000 | −700 | 30 | 3.0E+06 | 3.3E+05 | 70 | 6.7E+05 |
| Counter | 2000 | 1000 | −700 | 40 | 3.0E+06 | 3.3E+05 | 60 | 1.0E+06 |
| With | 2000 | 1000 | −700 | 10 | 3.0E+06 | 3.3E+05 | 90 | 0.0E+00 |
| With | 2000 | 1000 | −700 | 20 | 3.0E+06 | 3.3E+05 | 80 | 3.3E+05 |
| With | 2000 | 1000 | −700 | 30 | 3.0E+06 | 3.3E+05 | 70 | 6.7E+05 |
| With | 2000 | 1000 | −700 | 40 | 3.0E+06 | 3.3E+05 | 60 | 1.0E+06 |

| | | White and solid charge amount difference (on developing roller) | | | Charge amount difference before and after 50K endurance printing | | |
|---|---|---|---|---|---|---|---|
| Moving direction of development and conveying rollers | Memory image Rank | Charge amount difference ΔQ/M | Charge amount difference/ white charge amount ΔQ/Qw | Rank | Charge amount difference ΔQ/M | Charge amount difference/ initial charge amount ΔQ/Qi | Rank |
| Counter | x | 8.4 | 0.20 | x | 5.7 | 0.14 | ○ |
| Counter | ○ | 2.3 | 0.05 | ◎ | 4.3 | 0.10 | ◎ |
| Counter | ○ | 1.8 | 0.04 | ◎ | 2.4 | 0.06 | ◎ |
| Counter | ○ | 3.5 | 0.08 | ○ | 3.1 | 0.07 | ◎ |
| With | x | 8.2 | 0.20 | x | 12.3 | 0.29 | Δ |
| With | x | 10.0 | 0.24 | x | 11.1 | 0.26 | Δ |
| With | x | 9.1 | 0.22 | x | 9.9 | 0.24 | ○ |
| With | x | 9.7 | 0.23 | x | 13.4 | 0.32 | Δ |

| White vs solid charge amount determination | | Charge amount fluctuation determination | |
|---|---|---|---|
| Rank | ΔQ/Qw | Rank | ΔQ/Qi |
| ◎ (Excellent) | ~0.06 | ◎ (Excellent) | ~0.12 |
| ○ (Good) | 0.06~0.12 | ○ (Good) | 0.12~0.24 |
| Δ (Unacceptable) | 0.12~0.18 | Δ (Acceptable) | 0.24~0.36 |
| x (Unacceptable) | 0.18 or more | x (Unacceptable) | 0.36 or more |

As shown in Table 7, in the case of With rotation, the amount of the magnetic brush on the conveying roller, which starts to come into contact with the development residual toner on the developing roller, is regulated by the regulating board, and in addition, since toner supply to the developing roller has not yet started, the magnetic brush is constituted from developer containing a specified amount of toner. Therefore, in the case of the With structure in which the carrier surface is covered with adhering toner, toner recovery from the developing roller is difficult even with the pumping action. This resulted in the generation of memory images. Since development residual toner was present on the developing roller on the upstream side in the roller rotation direction in the supply/recovery region or at a lower position where toner supply to the developing roller should be performed, the toner displacement amount from the magnetic brush on the conveying roller to the developing roller decreased, which hindered detachment of the charged particles which should have occurred upon movement of the toner. As a result, the charging performance compensating function stopped working and thereby the toner charge amount was considered to be decreased. Therefore, it was found out that from the viewpoint of prevention of memory images and implementation of the sufficient toner charging performance compensating function by the charged particle, the developing roller and the conveying roller need to rotate counter (direction opposite of FIG. 1) as shown in FIG. 1.

Although the present invention has fully been explained based on the preferred embodiments and each experimental example, it should be understood that the present invention is not limited to the embodiments disclosed and various improvements and modifications are possible. For example, although the developer 2 for use in the developing device 34 has been explained to contain the carrier 4, the toner 6, and the charged particle 8, the present invention is also applicable to the developing device using the developer which does not contain the charged particle.

What is claimed is:

1. A developing device using developer containing a toner and a carrier to makes an electrostatic latent image on an electrostatic latent image bearing body into a visible image, comprising:

developer containing a toner and a carrier, the toner being charged to a first polarity by frictional contact between the toner and the carrier, while the carrier being charged to a second polarity which is different from the first polarity;

a first conveyance member which is rotationally driven;

a second conveyance member which faces the first conveyance member via a first region, which is rotationally driven so as to move to a direction opposed to the first conveyance member in the first region, and which faces the electrostatic latent image bearing body via a second region;

first electric field unit which forms a first electric field between the first conveyance member and the second conveyance member to move the toner in the developer retained by the first conveyance member to the second conveyance member; and second electric field forming unit which forms a second electric field between the second conveyance member and the electrostatic latent image bearing body to move the toner retained by the second conveyance member to an electrostatic latent image on the electrostatic latent image bearing body for making the electrostatic latent image into a visible image, wherein the first electric field is an oscillating electric field having both a function to supply the toner to the second conveyance member and a function to collect the toner from the second conveyance member while a time average field strength is biased to a side where the toner is supplied from the first conveyance member to the second conveyance member, and wherein a time ratio for carrying out a function to collect the toner from the second conveyance member to the first conveyance member is 60 to 80%.

2. The developing device according to claim 1, wherein the developer further contains a charged particle, and the charged particle is supplied in a state of being detachably retained on a surface of the toner, so that when the charged particle is retained on a surface of the carrier after being detached from the surface of the toner, the charged particle charges the toner to the first polarity by frictional contact with the toner.

3. The developing device of claim 1, wherein field strength of the first electric field is $2.5\times10^6$ V/m or more.

4. The developing device according to claim 1, wherein a DC bias is applied to the second conveyance member, while an oscillating bias, which sets a time ratio for carrying out a function to collect the toner from the second conveyance member to the first conveyance member to 60 to 80%, is applied to the first conveyance member.

5. The developing device according to claim 1, wherein a second oscillating bias is applied to the second conveyance member, while a first oscillating bias having phase synchronization with the second oscillating bias and having a large amplitude is applied to the first conveyance member.

6. An image forming apparatus comprising the developing device according to claim 1.

* * * * *